US010600320B2

(12) United States Patent
Sun et al.

(10) Patent No.: US 10,600,320 B2
(45) Date of Patent: Mar. 24, 2020

(54) SYSTEMS AND METHODS FOR CONTROLLING TRAFFIC LIGHTS

(71) Applicant: BEIJING DIDI INFINITY TECHNOLOGY AND DEVELOPMENT CO., LTD., Beijing (CN)

(72) Inventors: Weili Sun, Beijing (CN); Xianghong Liu, Tianjin (CN); Jianfeng Zheng, Beijing (CN); Jinqing Zhu, Beijing (CN)

(73) Assignee: BEIJING DIDI INFINITY TECHNOLOGY AND DEVELOPMENT CO., LTD., Beijing (CN)

( * ) Notice: Subject to any disclaimer, the term of this patent is extended or adjusted under 35 U.S.C. 154(b) by 0 days.

(21) Appl. No.: 16/220,250

(22) Filed: Dec. 14, 2018

(65) Prior Publication Data

US 2020/0035096 A1 Jan. 30, 2020

Related U.S. Application Data

(63) Continuation of application No. PCT/CN2018/096931, filed on Jul. 25, 2018.

(51) Int. Cl.
*G08G 1/01* (2006.01)
*G08G 1/082* (2006.01)
(Continued)

(52) U.S. Cl.
CPC ..... *G08G 1/082* (2013.01); *G08G 1/0129* (2013.01); *G08G 1/0145* (2013.01); *G08G 1/08* (2013.01); *G08G 1/095* (2013.01)

(58) Field of Classification Search
USPC ..... 701/117
See application file for complete search history.

(56) References Cited

U.S. PATENT DOCUMENTS 8,830,086 B2 9/2014 Cao et al.
9,412,271 B2 * 8/2016 Sharma ..... G08G 1/052
(Continued)

FOREIGN PATENT DOCUMENTS

CN 101206801 A 6/2008
CN 102842238 A 12/2012
(Continued)

OTHER PUBLICATIONS

International Search Report in PCT/CN2018/096931 dated May 7, 2019, 5 pages.
(Continued)

*Primary Examiner* — Brent Swarthout
(74) *Attorney, Agent, or Firm* — Metis IP LLC

(57) ABSTRACT

A method for controlling traffic lights is provided. The method may include obtaining historical track data of a plurality of vehicles. The method may include obtaining a congestion period. The method may include determining a discharge speed during the congestion period based on a portion of the historical track data corresponding to the congestion period. The method may further include determining an offset value based on a length of the road, the discharge speed, a cycle length of a first traffic light at the downstream intersection, a cycle length of a second traffic light at the upstream intersection, and a time length of a green light of the second traffic light being lit, and determining a signal timing of the second traffic light based on the offset value.

20 Claims, 15 Drawing Sheets

(51) Int. Cl.
*G08G 1/095* (2006.01)
*G08G 1/08* (2006.01)

(56) References Cited

U.S. PATENT DOCUMENTS

| | | | | |
|---|---|---|---|---|
| 2002/0116118 | A1 | 8/2002 | Stallard et al. | |
| 2008/0094250 | A1* | 4/2008 | Myr | G08G 1/04 340/909 |
| 2013/0106620 | A1 | 5/2013 | Cao et al. | |
| 2014/0159924 | A1 | 6/2014 | Lee | |
| 2014/0324326 | A1 | 10/2014 | Taylor | |
| 2016/0042641 | A1* | 2/2016 | Smith | G08G 1/0116 340/917 |
| 2017/0124863 | A1 | 5/2017 | Dumazert et al. | |
| 2017/0140645 | A1 | 5/2017 | Balid et al. | |

FOREIGN PATENT DOCUMENTS

| | | | |
|---|---|---|---|
| CN | 103927892 | A | 7/2014 |
| CN | 104240523 | B | 4/2016 |
| CN | 106097736 | A | 11/2016 |
| CN | 103208191 | B | 12/2016 |
| CN | 106600992 | A | 4/2017 |
| CN | 107331172 | A | 11/2017 |
| JP | 4003054 | B2 | 11/2007 |
| WO | 2017166474 | A1 | 10/2017 |

OTHER PUBLICATIONS

Written Opinion in PCT/CN2018/096931 dated May 7, 2019, 5 pages.
Bao-Lin Ye et al., A Method for Signal Coordination in Large-Scale Urban Road Networks, Mathematical Problems in Engineering, 2015.
Vinh Thong Ta, Automated Road Traffic Congestion Detection and Alarm Systems: Incorporating V2I communications into ATCSs, 2016.
The Extended European Search Report in European Application No. 18812020.8 dated Oct. 8, 2019, 10 pages.

* cited by examiner

SYSTEMS AND METHODS FOR CONTROLLING TRAFFIC LIGHTS

CROSS-REFERENCE TO RELATED APPLICATIONS

This application is a Continuation of International Application No. PCT/CN2018/096931, filed on Jul. 25, 2018, the contents of which are incorporated herein by reference.

TECHNICAL FIELD

The present disclosure generally relates to systems and methods for traffic control, and more particularly, relates to systems and methods for controlling traffic lights.

BACKGROUND

With more and more vehicles on the street in urban areas, traffic congestion becomes part of people's daily lives. In many forms of traffic congestion, traffic overflow is undoubtedly a more serious one. Traffic overflow is defined in a certain flow direction of a certain section, caused by the influence of the factors such as road planning or traffic signal timing. In a traffic overflow, a queue of vehicles accumulates waiting for traffic within a certain period is greater than the length of the road section, and the queue extends to the upstream intersection. The spillover of the queue may lead to the gridlock at the intersection. Therefore, it is desirable to develop systems or methods for avoiding or reducing the queue spillover in order to alleviate traffic congestion.

SUMMARY

According to an aspect of the present disclosure, a method for controlling traffic lights of an upstream intersection and a downstream intersection linked by a road is provided. The method may include one or more of the following operations. A processor may obtain historical track data of a plurality of vehicles that passed the road, the upstream intersection, and the downstream intersection over a historical period. The processor may obtain a congestion period. The processor may determine a discharge speed during the congestion period based on a portion of the historical track data corresponding to the congestion period. The processor may further determine an offset value based on a length of the road, the discharge speed, a cycle length of a first traffic light, a cycle length of a second traffic light, and a time length of a green light of the second traffic light being lit, wherein the first traffic light being at the downstream intersection, the second traffic light being at the upstream intersection, the cycle length of the first traffic light being equal to the cycle length of the second traffic light. The processor may determine a signal timing of the second traffic light based on the offset value.

In some embodiments, the historical period may include a plurality of workdays.

In some embodiments, the historical track data of the plurality of vehicles may include data of positions of the plurality of vehicles on the road and corresponding time points at which the plurality of vehicles at the positions.

In some embodiments, the processor may determine, for each of a plurality of first vehicles that pass through a boundary between the road and the downstream intersection during the congestion period, a relative start time point based on historical track data corresponding to the each of the plurality of first vehicles. The processor may further determine the discharge speed based on the relative start time points of the plurality of first vehicles.

In some embodiments, the processor may obtain an actual start time point of the each of the plurality of first vehicles that the each of the plurality of first vehicles started to move from a stop condition and across the boundary between the road and the downstream intersection during a period of the green light of the first traffic light being lit. The processor may obtain a start time point of the period of the green light of the first traffic light being lit, and further determine the relative start time point based on the actual start time point of the each of the plurality of first vehicles and the start time point of the period of the green light of the first traffic light being lit.

In some embodiments, the processor may determine the discharge speed based on the relative start time points of the plurality of first vehicles and corresponding positions of the plurality of first vehicles at the relative time points.

In some embodiments, the processor may determine an offset value range based on the length of the road, the discharge speed, the cycle length of the first traffic light, the cycle length of the second traffic light, and the time length of the green light of the second traffic light being lit, and determine the offset value based on the offset value range.

In some embodiments, the length of the road may include a length of the upstream intersection.

In some embodiments, the processor may control the second traffic light to delay for the offset value relative to the first traffic light corresponding to the congestion period.

In some embodiments, the processor may determine a first time point that the green light of the first traffic light starts to be on for a first time. The processor may determine a second time point based on the first time point and the offset value. The processor may extend a period of a red light of the second traffic light to the second time point. The processor may light the green light of the second traffic light at the second time point.

According to another aspect of the present disclosure, a system is provided. The system may include at least one storage medium and at least one processor configured to communicate with the at least one storage medium. The at least one storage medium may include a set of instructions. When the at least one storage medium executes the set of instructions, the at least one processor may be directed to perform one or more of the following operations. The at least one processor may obtain historical track data of a plurality of vehicles that passed the road, the upstream intersection, and the downstream intersection over a historical period. The at least one processor may obtain a congestion period. The at least one processor may determine a discharge speed during the congestion period based on a portion of the historical track data corresponding to the congestion period. The at least one processor may further determine an offset value based on a length of the road, the discharge speed, a cycle length of a first traffic light, a cycle length of a second traffic light, and a time length of a green light of the second traffic light being lit, wherein the first traffic light being at the downstream intersection, the second traffic light being at the upstream intersection, the cycle length of the first traffic light being equal to the cycle length of the second traffic light. The at least one processor may determine a signal timing of the second traffic light based on the offset value.

According to another aspect of the present disclosure, a non-transitory computer readable medium is provided. The non-transitory computer readable medium may comprise executable instructions that cause at least one processor to effectuate a method. The method may include one or more of the following operations. The at least one processor may obtain historical track data of a plurality of vehicles that passed the road, the upstream intersection, and the downstream intersection over a historical period. The at least one processor may obtain a congestion period. The at least one processor may determine a discharge speed during the congestion period based on a portion of the historical track data corresponding to the congestion period. The at least one processor may further determine an offset value based on a length of the road, the discharge speed, a cycle length of a first traffic light, a cycle length of a second traffic light, and a time length of a green light of the second traffic light being lit, wherein the first traffic light being at the downstream intersection, the second traffic light being at the upstream intersection, the cycle length of the first traffic light being equal to the cycle length of the second traffic light. The at least one processor may determine a signal timing of the second traffic light based on the offset value.

BRIEF DESCRIPTION OF THE DRAWINGS

The present disclosure is further described in terms of exemplary embodiments. These exemplary embodiments are described in detail with reference to the drawings. The drawings are not to scale. These embodiments are non-limiting exemplary embodiments, in which like reference numerals represent similar structures throughout the several views of the drawings, and wherein.

DETAILED DESCRIPTION

Figure 1:
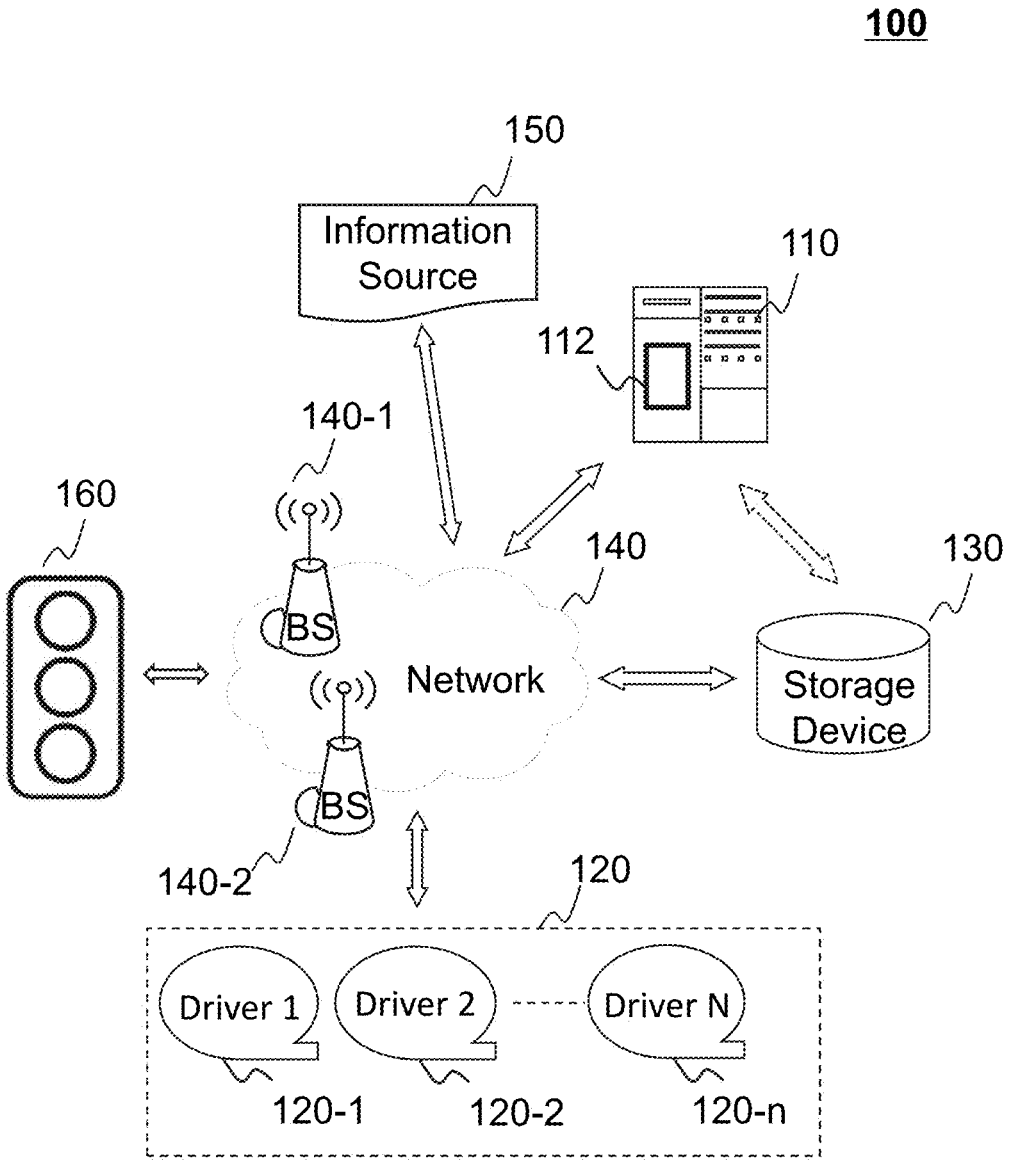
FIG. 1 is a schematic diagram illustrating an exemplary system for controlling traffic lights according to some embodiments of the present disclosure.

In order to illustrate the technical solutions related to the embodiments of the present disclosure, brief introduction of the drawings referred to in the description of the embodiments is provided below. Obviously, drawings described below are only some examples or embodiments of the present disclosure. Those having ordinary skills in the art, without further creative efforts, may apply the present disclosure to other similar scenarios according to these drawings. Unless stated otherwise or obvious from the context, the same reference numeral in the drawings refers to the same structure and operation.

As used in the disclosure and the appended claims, the singular forms "a," "an," and "the" include plural referents unless the content clearly dictates otherwise. It will be further understood that the terms "comprises," "comprising," "includes," and/or "including" when used in the disclosure, specify the presence of stated steps and elements, but do not preclude the presence or addition of one or more other steps and elements.

Some modules of the system may be referred to in various ways according to some embodiments of the present disclosure. However, any number of different modules may be used and operated in a client terminal and/or a server. These modules are intended to be illustrative, not intended to limit the scope of the present disclosure. Different modules may be used in different aspects of the system and method.

According to some embodiments of the present disclosure, flowcharts are used to illustrate the operations performed by the system. It is to be expressly understood, the operations above or below may or may not be implemented in order. Conversely, the operations may be performed in inverted order, or simultaneously. Besides, one or more other operations may be added to the flowcharts, or one or more operations may be omitted from the flowchart.

Technical solutions of the embodiments of the present disclosure are described with reference to the drawings as described below. It is obvious that the described embodiments are not exhaustive and are not limiting. Other embodiments obtained, based on the embodiments set forth in the present disclosure, by those with ordinary skill in the art without any creative works are within the scope of the present disclosure.

In an aspect, the present disclosure is directed to systems and methods for controlling traffic lights. The system may determine a discharge speed of a vehicle queue from the downstream intersection reaching the upstream stop line during a congestion period based on historical vehicle track data of a plurality of vehicles. The system may determine the light-cycle of a traffic light at the upstream intersection based on the discharge speed. The system may further control the traffic light based on the light-cycle.

FIG. 1 is a schematic diagram illustrating an exemplary system for controlling traffic lights according to some embodiments of the present disclosure. For example, the system 100 may be a platform for determining a signal timing to avoid or reduce vehicle spillover based on the track data of the vehicles obtained by the system 100. The system 100 may include a server 110, a driver terminal 120, a storage device 130, a network 140, an information source 150, and traffic lights 160. The server 110 may include a processing engine 112.

In some embodiments, the server 110 may perform a plurality of operations to determine the signal timing of the traffic lights 160. The server 110 may control the traffic lights 160 according to the determined signal timing. In some embodiments, the server 110 may obtain the track data of a plurality of vehicles. The server 110 may determine the signal timing of the traffic lights 160 based on the collected track data. In some embodiments, the server 110 may be a single server or a server group. The server group may be centralized, or distributed (e.g., the server 110 may be a distributed system). In some embodiments, the server 110 may be local or remote. For example, the server 110 may access information and/or data stored in the driver terminal 120, the information source 150, and/or the storage device 130 via the network 140. As another example, the server 110 may be directly connected to the driver terminal 120 and/or the storage device 130 to access stored information and/or data. In some embodiments, the server 110 may be implemented on a cloud platform. Merely by way of example, the cloud platform may include a private cloud, a public cloud, a hybrid cloud, a community cloud, a distributed cloud, an inter-cloud, a multi-cloud, or the like, or any combination thereof. In some embodiments, the server 110 may be implemented on a computing device having one or more components illustrated in FIG. 2 in the present disclosure.

In some embodiments, the server 110 may include a processing engine 112. The processing engine 112 may determine a signal timing for controlling the traffic lights 160 to avoid or reduce the spillover. In some embodiments, the processing engine 112 may include one or more processing engines (e.g., single-core processing engine(s) or multi-core processor(s)). Merely by way of example, the processing engine 112 may include a central processing unit (CPU), an application-specific integrated circuit (ASIC), an application-specific instruction-set processor (ASIP), a graphics processing unit (GPU), a physics processing unit (PPU), a digital signal processor (DSP), a field programmable gate array (FPGA), a programmable logic device (PLD), a controller, a microcontroller unit, a reduced instruction-set computer (RISC), a microprocessor, or the like, or any combination thereof.

In some embodiments, the driver terminal 120 may transmit positioning information associated with a vehicle to the server 110. For example, the driver terminal 120 may be a smartphone equipped with a global positioning system (GPS) chipset capable of determining the position of the smartphone. The driver terminal 120 may determine its positions over time and transmit the position data (also referred as the track data) to the server 110. The server 110 may treat the position data as the track data of a vehicle associated with the user of the driver terminal 120 since the positions of the driver terminal 120 may be the same (or almost the same) as the positions of the vehicle. As another example, the driver terminal 120 may be a computing device installed in a vehicle and equipped with a GPS chipset. The driver terminal 120 may determine its positions over time and transmit the position data to the server 120. The server 110 may further obtain track data corresponding to the positioning information. For example, the track data may include a plurality of positions of the driver terminal 120 and/or the vehicles.

In some embodiments, the driver terminal 120 may include a mobile device, a tablet computer, a laptop computer, and a built-in device in a motor vehicle, or the like, or any combination thereof. In some embodiments, the mobile device may include a smart home device, a wearable device, a smart mobile device, a virtual reality device, an augmented reality device, or the like, or any combination thereof. In some embodiments, the smart home device may include a smart lighting device, a control device of an intelligent electrical apparatus, a smart monitoring device, a smart television, a smart video camera, an interphone, or the like, or any combination thereof. In some embodiments, the wearable device may include a smart bracelet, a smart footgear, a smart glass, a smart helmet, a smartwatch, a smart clothing, a smart backpack, a smart accessory, or the like, or any combination thereof. In some embodiments, the smart mobile device may include a smartphone, a personal digital assistant (PDA), a gaming device, a navigation device, or the like, or any combination thereof. In some embodiments, the built-in device in the motor vehicle may include an onboard computer, an onboard television, etc. In some embodiments, the driver terminal 120 may include a device with positioning technology for locating the position of the vehicle (e.g., a device equipped with a GPS chipset).

The storage device 130 may store data and/or instructions. In some embodiments, the storage device 130 may store data obtained/acquired from the driver terminal 120. In some embodiments, the storage device 130 may store data and/or instructions that the server 110 may execute or use to perform exemplary methods described in the present disclosure. In some embodiments, the storage device 130 may include a mass storage, removable storage, a volatile read-and-write memory, a read-only memory (ROM), or the like, or any combination thereof. Exemplary mass storage may include a magnetic disk, an optical disk, a solid-state drive, etc. Exemplary removable storage may include a flash drive, a floppy disk, an optical disk, a memory card, a zip disk, a magnetic tape, etc. Exemplary volatile read-and-write memory may include random-access memory (RAM). Exemplary RAM may include a dynamic RAM (DRAM), a double date rate synchronous dynamic RAM (DDR SDRAM), a static RAM (SRAM), a thyristor RAM (T-RAM), and a zero-capacitor RAM (Z-RAM), etc. Exemplary ROM may include a mask ROM (MROM), a programmable ROM (PROM), an erasable programmable ROM (PEROM), an electrically erasable programmable ROM (EEPROM), a compact disk ROM (CD-ROM), and a digital versatile disk ROM, etc. In some embodiments, the storage device 130 may be implemented on a cloud platform. Merely by way of example, the cloud platform may include a private cloud, a public cloud, a hybrid cloud, a community cloud, a distributed cloud, an inter-cloud, a multi-cloud, or the like, or any combination thereof.

In some embodiments, the storage device 130 may be connected to the network 140 to communicate with one or more components in the system 100 (e.g., the server 110, the driver terminal 120). One or more components in the system 100 may access the data or instructions stored in the storage device 130 via the network 140. In some embodiments, the storage device 130 may be directly connected to or communicate with one or more components in the system 100

(e.g., the server 110, the driver terminal 120). In some embodiments, the storage device 130 may be part of the server 110.

The network 140 may facilitate exchange of information and/or data. In some embodiments, one or more components in the system 100 (e.g., the server 110, the driver terminal 120, the storage device 130) may send and/or receive information and/or data to/from another component (s) in the system 100 via the network 140. For example, the server 110 may obtain/acquire the trajectory data of the vehicles from a terminal via the network 140. In some embodiments, the network 140 may be any type of wired or wireless network, or combination thereof. Merely by way of example, the network 140 may include a cable network, a wireline network, an optical fiber network, a tele communications network, an intranet, an Internet, a local area network (LAN), a wide area network (WAN), a wireless local area network (WLAN), a metropolitan area network (MAN), a wide area network (WAN), a public telephone switched network (PSTN), a Bluetooth™ network, a ZigBee™ network, a near field communication (NFC) network, a global system for mobile communications (GSM) network, a code-division multiple access (CDMA) network, a time-division multiple access (TDMA) network, a general packet radio service (GPRS) network, an enhanced data rate for GSM evolution (EDGE) network, a wideband code division multiple access (WCDMA) network, a high speed downlink packet access (HSDPA) network, a long term evolution (LTE) network, a user datagram protocol (UDP) network, a transmission control protocol/Internet protocol (TCP/IP) network, a short message service (SMS) network, a wireless application protocol (WAP) network, a ultra wide band (UWB) network, an infrared ray, or the like, or any combination thereof. In some embodiments, the system 100 may include one or more network access points. For example, the system 100 may include wired or wireless network access points such as base stations and/or wireless access points 140-1, 140-2, . . . , through which one or more components of the system 100 may be connected to the network 140 to exchange data and/or information.

The information source 150 may be a source configured to provide other information for the system 100. The information source 150 may provide the system 100 with service information, such as weather conditions, traffic information, information of laws and regulations, news events, or the like. In some embodiments, the information source 150 may include an official traffic database, which provides historical and/or current traffic data (e.g., a congestion period, traffic light pattern). The server 110 may obtain the cycle length of a traffic light from the information source 150. The cycle length of a traffic light refers to a periodical duration of the traffic light including a green light duration, a red light duration, and a yellow light duration (if necessary). In the present disclosure, the red-light duration and the green-light duration are discussed while the yellow-light duration is not discussed, but a person having ordinary skill in the art would understand how to include the yellow-light duration in view of the present disclosure without undue experimentation. In some embodiments, the yellow-light duration may be considered to be included in the green-light duration or the red light duration. The information source 150 may be implemented in a single central server, multiple servers connected via a communication link, or multiple personal devices. When the information source 150 is implemented in multiple personal devices, the personal devices can generate content (e.g., as referred to as the "user-generated content"), for example, by uploading text, voice, image, and video to a cloud server. An information source may be generated by the multiple personal devices and the cloud server.

Figure 2:
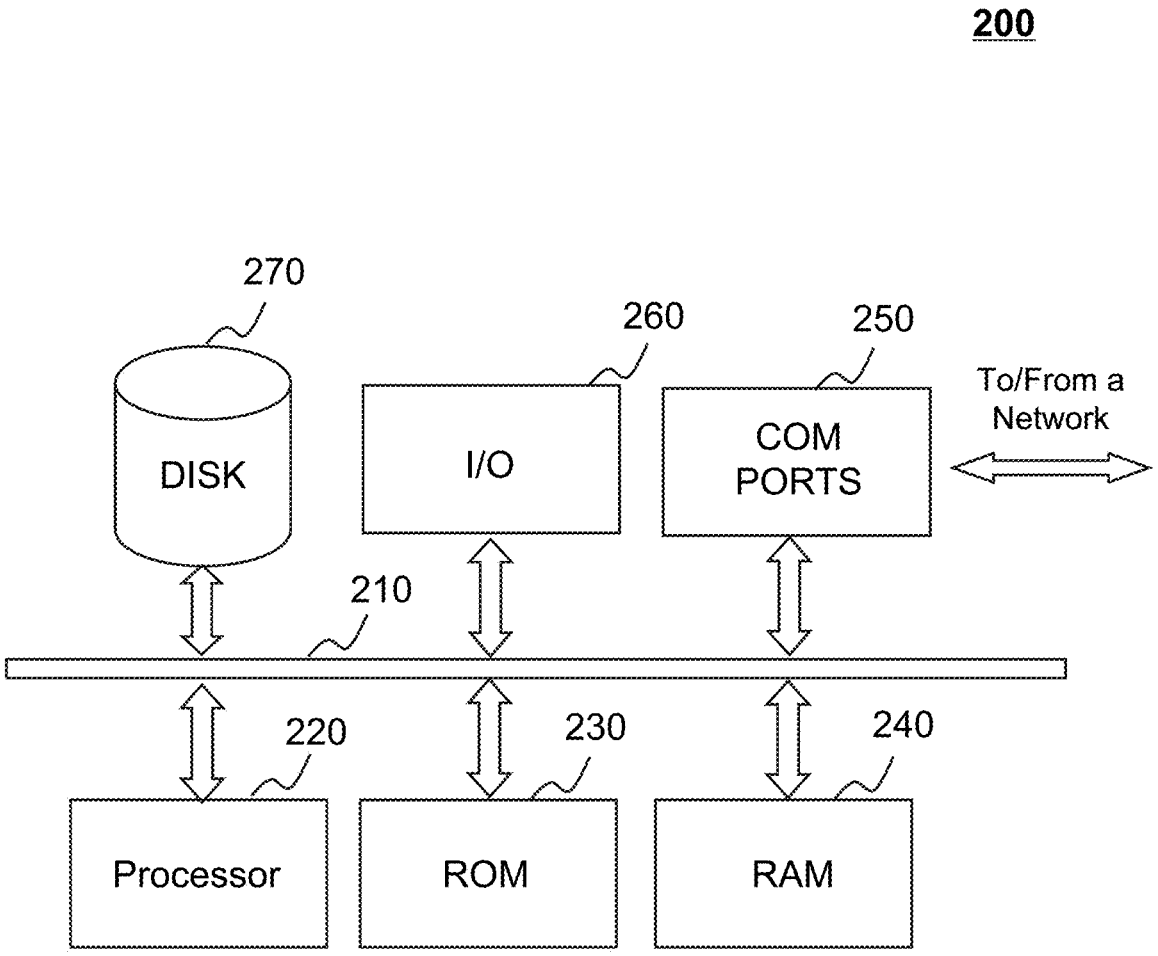
FIG. 2 is a schematic diagram illustrating exemplary components of a computing device according to some embodiments of the present disclosure.

FIG. 2 is a schematic diagram illustrating exemplary components of a computing device according to some embodiments of the present disclosure. The server 110, the driver terminal 120, and/or the storage device 130 may be implemented on the computing device 200 according to some embodiments of the present disclosure. The particular system may use a functional block diagram to explain the hardware platform containing one or more user interfaces. The computer may be a computer with general or specific functions. Both types of the computers may be configured to implement any particular system according to some embodiments of the present disclosure. Computing device 200 may be configured to implement any components that perform one or more functions disclosed in the present disclosure. For example, the computing device 200 may implement any component of the system 100 as described herein. In FIGS. 1 and 2, only one such computer device is shown purely for convenience purposes. One of ordinary skill in the art would understand at the time of filing of this application that the computer functions relating to the service as described herein may be implemented in a distributed fashion on a number of similar platforms, to distribute the processing load.

The computing device 200, for example, may include COM ports 250 connected to and from a network connected thereto to facilitate data communications. The computing device 200 may also include a processor (e.g., the processor 220), in the form of one or more processors (e.g., logic circuits), for executing program instructions. For example, the processor 220 may include interface circuits and processing circuits therein. The interface circuits may be configured to receive electronic signals from a bus 210, wherein the electronic signals encode structured data and/or instructions for the processing circuits to process. The processing circuits may conduct logic calculations, and then determine a conclusion, a result, and/or an instruction encoded as electronic signals. Then the interface circuits may send out the electronic signals from the processing circuits via the bus 210.

The exemplary computing device may include the internal communication bus 210, program storage and data storage of different forms including, for example, a disk 270, and a read-only memory (ROM) 230, or a random access memory (RAM) 240, for various data files to be processed and/or transmitted by the computing device. The exemplary computing device may also include program instructions stored in the ROM 230, RAM 240, and/or another type of non-transitory storage medium to be executed by the processor 220. The methods and/or processes of the present disclosure may be implemented as the program instructions. The computing device 200 also includes an I/O component 260, supporting input/output between the computer and other components. The computing device 200 may also receive programming and data via network communications.

Merely for illustration, only one CPU and/or processor is illustrated in FIG. 2. Multiple CPUs and/or processors are also contemplated; thus operations and/or method steps performed by one CPU and/or processor as described in the present disclosure may also be jointly or separately performed by the multiple CPUs and/or processors. For example, if in the present disclosure the CPU and/or processor of the computing device 200 executes both step A and step B, it should be understood that step A and step B may also be performed by two different CPUs and/or processors jointly or separately in the computing device 200 (e.g., the first processor executes step A and the second processor executes step B, or the first and second processors jointly execute steps A and B).

Figure 3:
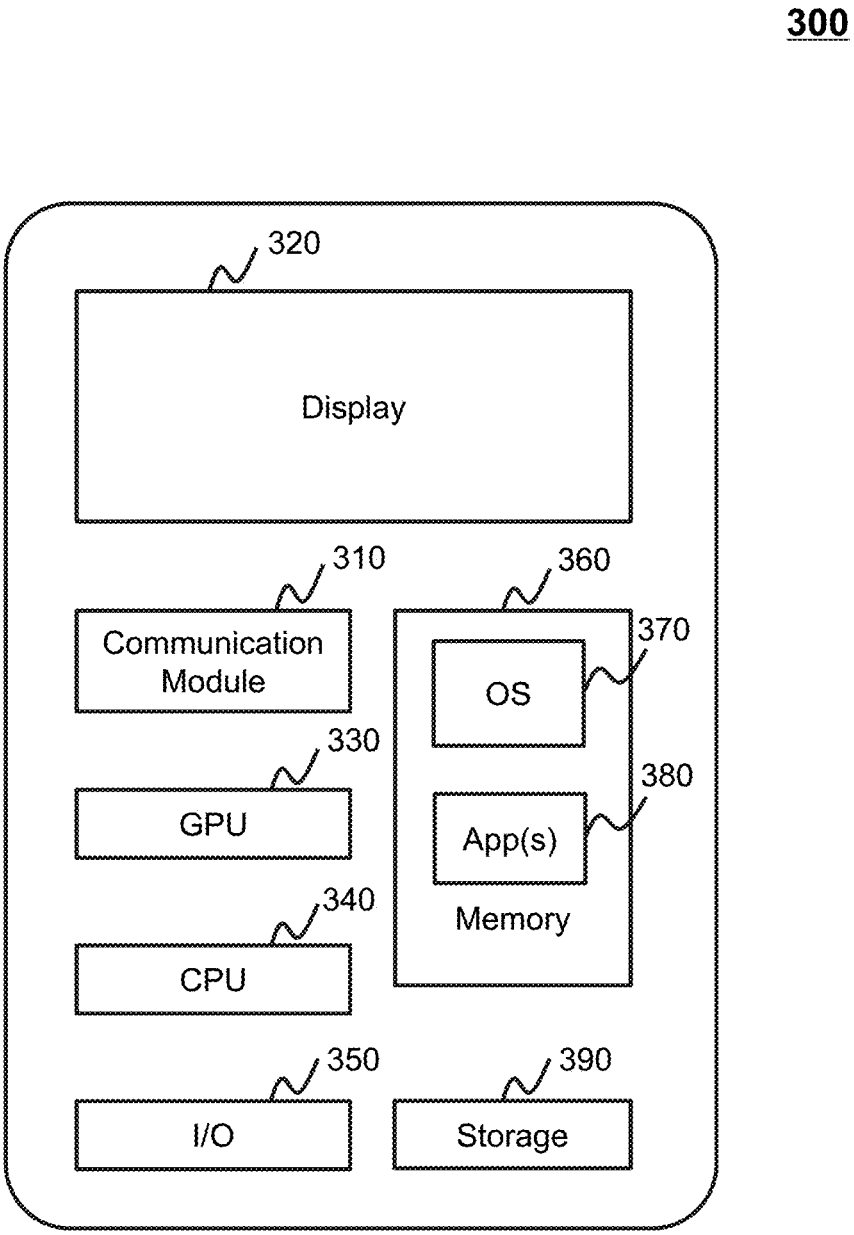
FIG. 3 is a schematic diagram illustrating hardware and/or software components of an exemplary mobile terminal according to some embodiments of the present disclosure.

FIG. 3 is a block diagram illustrating exemplary hardware and/or software components of an exemplary mobile device according to some embodiments of the present disclosure. The driver terminal 120 may be implemented on the mobile device 300 according to some embodiments of the present disclosure. As illustrated in FIG. 3, the mobile device 300 may include a communication module 310, a display 320, a graphics processing unit (GPU) 330, a central processing unit (CPU) 340, an I/O 350, a memory 360, and a storage 390. The CPU 340 may include interface circuits and processing circuits similar to the processor 220. In some embodiments, any other suitable component, including but not limited to a system bus or a controller (not shown), may also be included in the mobile device 300. In some embodiments, a mobile operating system 370 (e.g., iOS™, Android™ Windows Phone™) and one or more applications 380 may be loaded into the memory 360 from the storage 390 in order to be executed by the CPU 340. The applications 380 may include a browser or any other suitable mobile apps for transmitting the trajectory data to the server 110. User interaction with the information stream may be achieved via the I/O devices 350 and provided to the processing engine 112 and/or other components of the system 100 via the network 140.

In order to implement various modules, units and their functions described above, a computer hardware platform may be used as hardware platforms of one or more elements (e.g., a component of the server 110 described in FIG. 1). Since these hardware elements, operating systems, and program languages are common, it may be assumed that persons skilled in the art may be familiar with these techniques and they may be able to provide information required in the traffic lights controlling according to the techniques described in the present disclosure. A computer with user interface may be used as a personal computer (PC), or other types of workstations or terminal devices. After being properly programmed, a computer with user interface may be used as a server. It may be considered that those skilled in the art may also be familiar with such structures, programs, or general operations of this type of computer device. Thus, extra explanations are not described for the figures.

Figure 4:
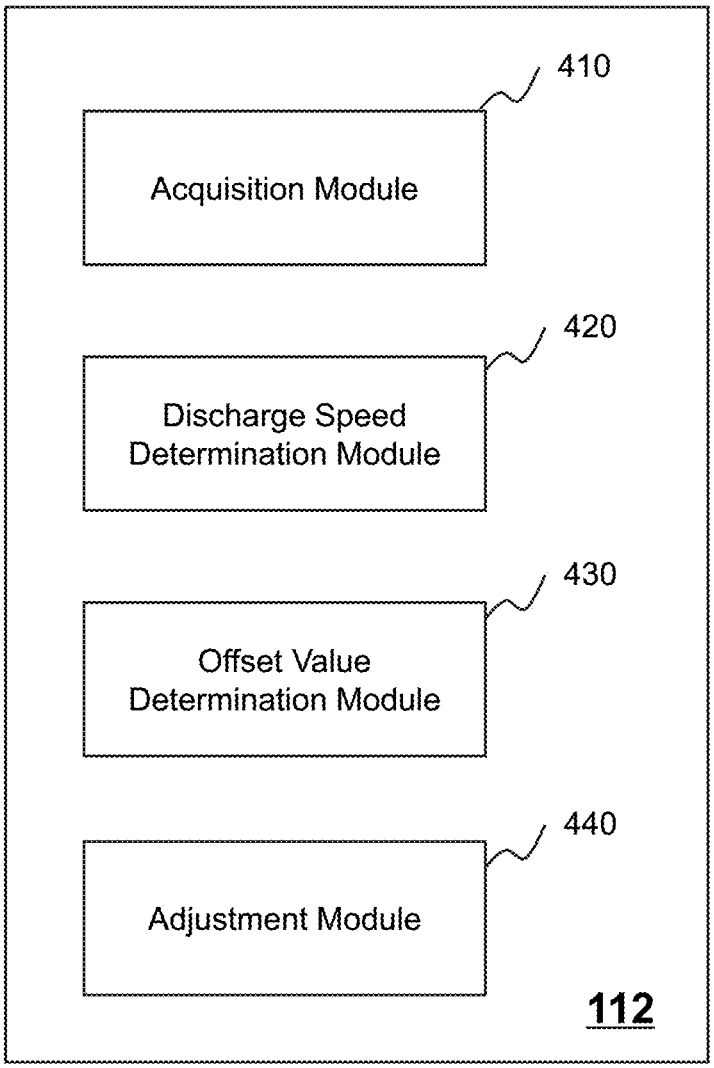
FIG. 4 is a block diagram illustrating an exemplary processing engine according to some embodiments of the present disclosure.

FIG. 4 is a block diagram illustrating an exemplary processing engine according to some embodiments of the present disclosure. The processing engine 112 may include an acquisition module 410, a discharge speed determination module 420, an offset value determination module 430 and an adjustment module 440. The modules may be hardware circuits of at least part of the processing engine 112. The modules may also be implemented as an application or set of instructions read and executed by the processing engine 112. Further, the modules may be any combination of the hardware circuits and the application/instructions. For example, the modules may be the part of the processing engine 112 when the processing engine 112 is executing the application/set of instructions.

The acquisition module 410 may obtain data from one or more components in the system 100 (e.g., the driver terminal 120 or the storage device 130). In some embodiments, the obtained data may include historical track data relating to a plurality of vehicles. In some embodiments, the obtained data may include a congestion period (e.g., rush hours in workdays). The acquisition module 410 may transmit the obtained data to storage (e.g., the storage device 130) for storing. The acquisition module 410 may transmit the obtained data to other modules of the processing engine 112 for further processing.

The discharge speed determination module 420 may determine a discharge speed based on the obtained historical track data. For example, the discharge speed determination module 420 may determine the discharge speed during the congestion period based on a portion of the historical track data. In some embodiments, the discharge speed determination module 420 may map the portion of historical track data to a cycle duration on a time-space diagram. In some embodiments, the discharge speed determination module 420 may determine a plurality of relative start time points of the plurality of vehicles. The discharge speed determination module 420 may determine the discharge speed based on the plurality of relative start time points of the plurality of vehicles.

The offset value determination module 430 may determine an offset value of a second traffic light relative to a first traffic light based on a length of the road, the discharge speed, a cycle length of the first traffic light, a cycle length of the second traffic light, and a time length of a green light of the second traffic light being lit. The cycle length of a traffic light refers to a periodical duration of the traffic light including a green light duration, a red light duration, and/or a yellow light duration. In some embodiments, the yellow-light duration may be considered to be included in the green-light duration or the red light duration. The first traffic light may be a traffic light at the downstream intersection. The second traffic light may be a traffic light at the upstream intersection. In some embodiments, the offset value determination module 430 may determine a relative time within a cycle at which the discharge wave from downstream intersection reaches upstream stop line of the upstream intersection. The offset value determination module 430 may further determine the offset value of the second traffic light relative to the first traffic light based on the relative time and the time length of a green light of the second traffic light. For example, the offset value determination module 430 may determine the offset value of the second traffic light relative to the first traffic light according to inequality (19).

Figure 14:
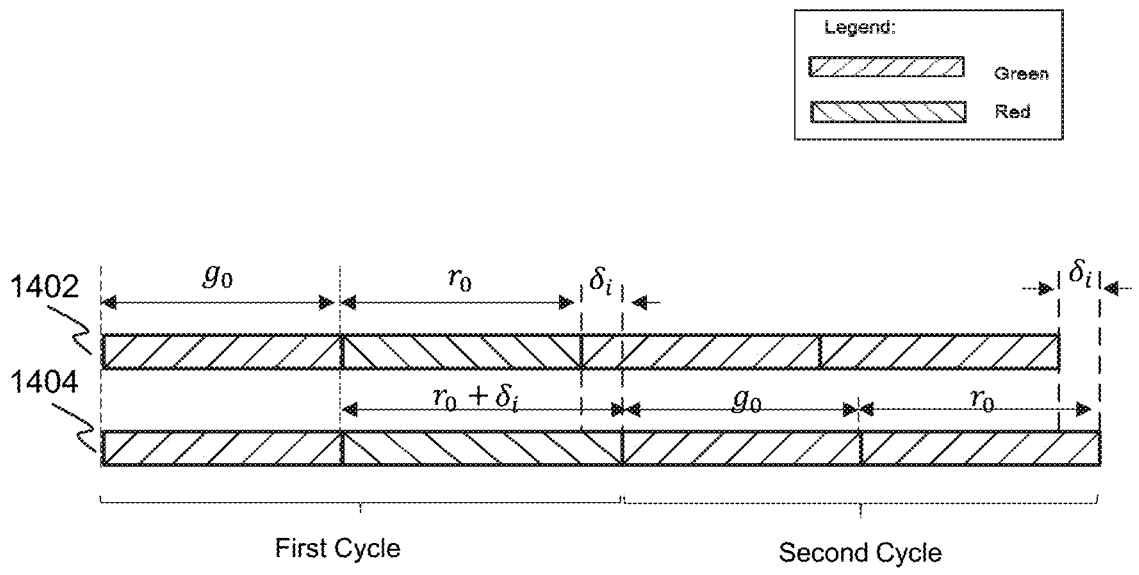
FIG. 14 is a schematic diagram illustrating an exemplary signal timing according to some embodiments of the present disclosure.

The adjustment module 440 may determine a signal timing of the second traffic light based on the offset value. In some embodiments, the adjustment module 440 may delay the second traffic light for a time duration that is the offset value during the congestion period. For example, the adjustment module 440 may determine the signal timing of the second traffic light as illustrated in FIG. 14.

It should be noted that the above description of the processing engine 112 is merely provided for the purposes of illustration, and not intended to limit the scope of the present disclosure. For persons having ordinary skills in the art, multiple variations and modifications may be made under the teachings of the present disclosure. For example, the processing engine 112 may further include a storage module facilitating data storage. However, those variations and modifications do not depart from the scope of the present disclosure.

Figure 5:
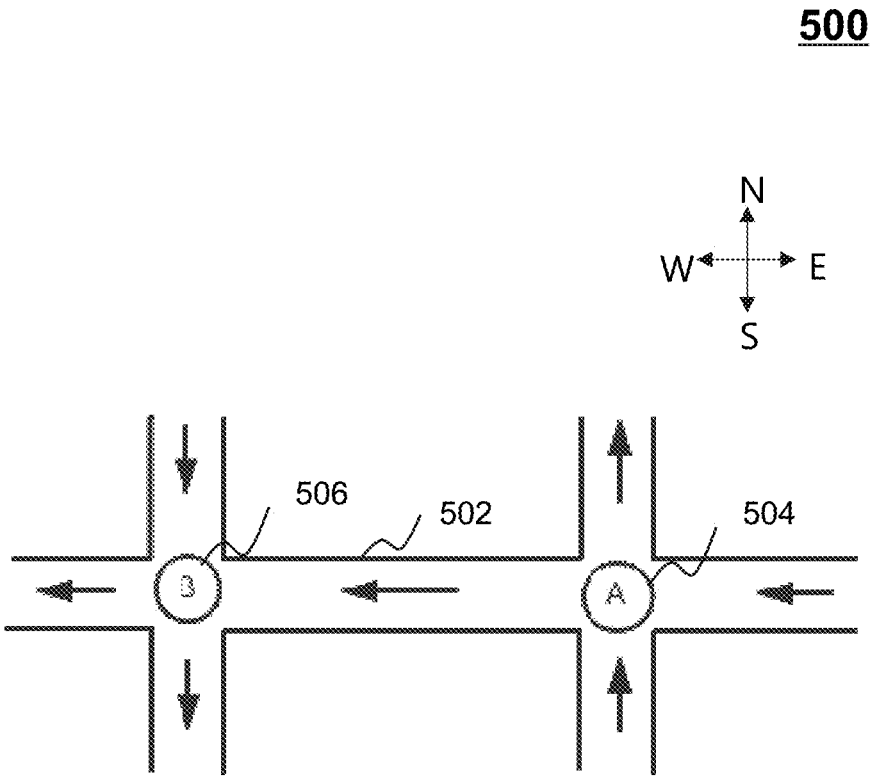
FIG. 5 is a schematic diagram illustrating an exemplary one-way road network according to some embodiments of the present disclosure.

FIG. 5 is a schematic diagram illustrating an exemplary one-way road network according to some embodiments of the present disclosure. FIG. 5 is a simplified one-way road network including an upstream intersection 504 (i.e., the intersection A) and a downstream intersection 506 (i.e., the intersection B) connected by a road 502. In some embodiments, the turning movements of vehicles in the one-way road network 500 may be forbidden. In some embodiments, when the traffic condition is gridlock at a period on the road 502, a plurality of vehicles in the queue may be stopped to wait on the road 502 to pass the downstream intersection 506. If the queue cannot be fully discharged within a cycle of a traffic light at the downstream intersection 506, a residual queue may be formed and even spill to the upstream intersection 504, which may cause the gridlock of the upstream intersection 504. On the other hand, a gridlock may begin with queue spillover on one road (or link) and then spread to the adjacent road (or link). If the queue spillover is reduced or controlled, the gridlock may be prevented. More descriptions about the queue spillover may be found elsewhere in the present disclosure (e.g., FIGS. 6, 7A-7B, and 8A-8B, and the descriptions thereof).

It should be noted that the above description is merely provided for the purposes of illustration, and not intended to limit the scope of the present disclosure. For persons having ordinary skills in the art, multiple variations and modifications may be made under the teachings of the present disclosure. For example, the one-way road network 500 may include but not limited that two intersections, such as three intersections.

Figure 6:
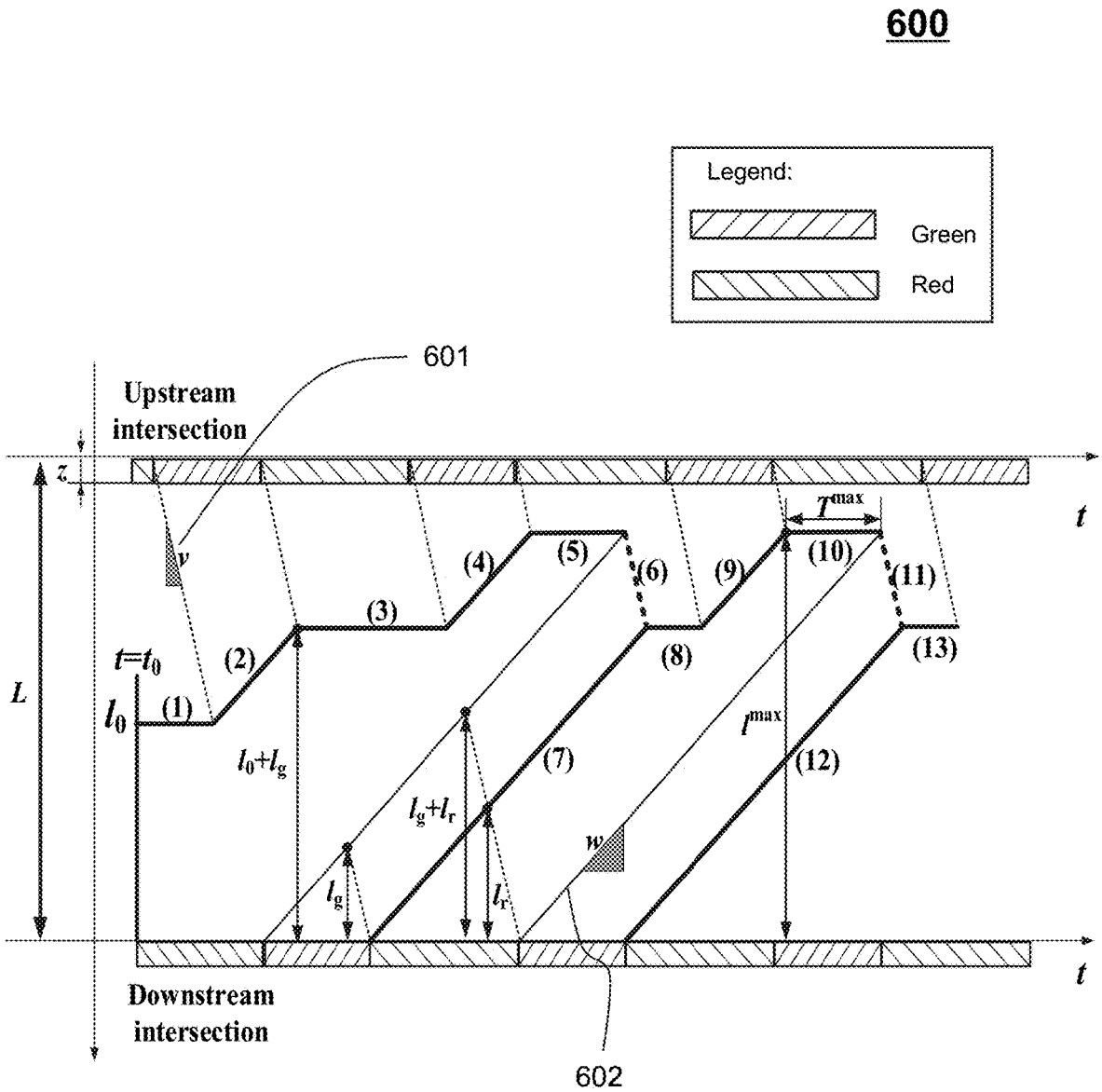
FIG. 6 is a schematic diagram illustrating exemplary queue length trajectories on one road according to some embodiments of the present disclosure.

FIG. 6 is a schematic diagram illustrating exemplary queue length trajectories on one road according to some embodiments of the present disclosure. FIG. 6 shows an example how the queue length trajectory (i.e., the position of the last queued vehicle) moves in a time-space diagram. The horizontal axis of the time-space diagram represents time, and the vertical axis of the time-space diagram represents position. A traffic light may be at a downstream intersection (which is also referred herein as the first traffic light), and a traffic light may be at an upstream intersection (which is also referred herein as the second traffic light). The downstream intersection (e.g., the downstream intersection 506 shown in FIG. 5) and the upstream intersection (e.g., the upstream intersection 504 shown in FIG. 5) may be connected by the road (e.g., the road 502). The length of the upstream intersection is z. The length of the road is L. In some embodiments, the length of the road may include the length of the upstream intersection, as illustrated in FIG. 6. Two groups of parallel auxiliary lines, for example, the auxiliary line 601 and the auxiliary line 602, are depicted to help the determination of the queue length. One group including the dashed auxiliary line 601 may start from a phase switch time of an upstream traffic signal and move toward the bottom right at a free flow speed v. The other group including the auxiliary line 602 may start from a phase switch time of a downstream signal and move towards top right at a backward propagate speed w. The queue length trajectory may be shown by a plurality of bold solid lines that consist of many stages such as stage (1), stage (2), . . . , and so on.

The time-space diagram in FIG. 6 may be designated as a time-varying queue length model that is developed using an LWR shockwave theory. The processor (e.g., the processing engine 112) may determine the time-varying queue length model based on certain assumptions. The assumptions may include: (a) the traffic is one-way and not include turning movements, for example, the one-way road network 500 as shown in FIG. 5; (b) vehicles with right-of-way always enter the intersection, even if the downstream road is full; (c) adequate vehicles are supplied at the origins. Therefore, vehicles would enter the link with the free flow speed (e.g., v) and discharge flow rate as long as the upstream traffic signal is green and the road is not blocked; (d) the two intersections have the same constant cycle length, denoted by c, and the same green split, denoted by $g_s$ for the subject road; (e) a free-flow offset is set so that the green band is maximized (equal to green time); (f) there are no sources or sinks on the link; (g) the traffic is described by a triangle fundamental model with the free flow speed v and a back propagation wave speed w (herein also referred to as a discharge speed). The triangle fundamental model may be denoted by Equation (1) as follows:

$$w = \frac{q_c - q_j}{\rho_c - \rho_j}, \tag{1}$$

where $q_c$ and $\rho_c$ represent a flow rate and a density for a discharging traffic state, respectively, and $q_j$ and $\rho_j$ represent the flow rate and the density for a jam traffic state, respectively. For those skilled in the art, the triangle fundamental model may be an essential model for researching a traffic problem and not described in detail in the present disclosure.

The queue length trajectory will increase if vehicles from the upstream join the queue (e.g., Stage (4)), and the queue length trajectory remain unchanged if no vehicle comes (e.g., Stage (5)). The decreasing lines (e.g., the bold dashed lines shown in Stage (6) in FIG. 6) may show the positions of the last vehicle of the queue during discharging. Without loss of generality, the initial condition at time $t=t_0$ may be assumed as that a queue with no vehicles (i.e., the number of the vehicles equal to $n_0$) accumulates on the road. The initial queue length may be given by $l_0=n_0\times\rho_j$. Due to a relatively large initial value of $l_0$, the initial queue may be not able to be dissolved in a first cycle but may be dissolved in a second cycle. In this case, $l_0$ may satisfy the following inequality (2):

$$l_r+l_g<l_0+l_g\leq 2(l_r+l_g) \tag{2},$$

where $l_g$ and $l_r$ denote the growth of the queue length in one green light period and one red light period, respectively. $l_g$ may be given by Equation (3) as follows:

$$l_g = g_s\frac{wv}{w+v}. \tag{3}$$

$l_r$ may be given by Equation (4) as follows:

$$l_r = r_0\frac{wv}{w+v} = (c-g_s)\frac{wv}{w+v}. \tag{4}$$

The queue length trajectory finally converges to a cyclic recurrent pattern shown by a combination of stages (7) to (10) in FIG. 6. A maximum queue length $l^{max}$ for this case may be given by Equation (s) as follows:

$$l^{max}=l_0+2l_g \tag{5}.$$

In this case, $T^{max}$ denotes the duration that the maximum queue length $l^{max}$ lasts. Equation (6) may be determined based on the similarity of triangles, as follows:

$$\frac{T^{max}}{c+g_s} = \frac{l^{max}-2l_g-l_r}{2l_g+l_r} = \frac{l_0-l_r}{2l_g+l_r}. \tag{6}$$

Then the value of $T^{max}$ may be determined by the Equation (7) as follows:

$$T^{max} = (l_0-l_r)\frac{c+g_s}{2l_g+l_r} = (l_0-l_r)\frac{wv}{w+v}. \tag{7}$$

In some embodiments, given different initial values of $l_0$, the processor may determine a general expression of $l^{max}$ and $T^{max}$ as follows:

$$l^{max} = l_0 + l_g \cdot \text{ceil}\left(\frac{l_0}{l_r}\right), \tag{8}$$

$$T^{max} = \left(l_0 - l_r \cdot \text{floor}\left(\frac{l_0}{l_r}\right)\right) \cdot \frac{wv}{w+v} = \text{mod}(l_0, l_r) \cdot \frac{wv}{w+v}, \tag{9}$$

where function ceil(x) rounds x to the nearest integer towards infinity, function floor(x) rounds x to the nearest integer towards minus infinity, and function mod(x, y) refers to a reminder after dividing x by y.

Figure 7A:
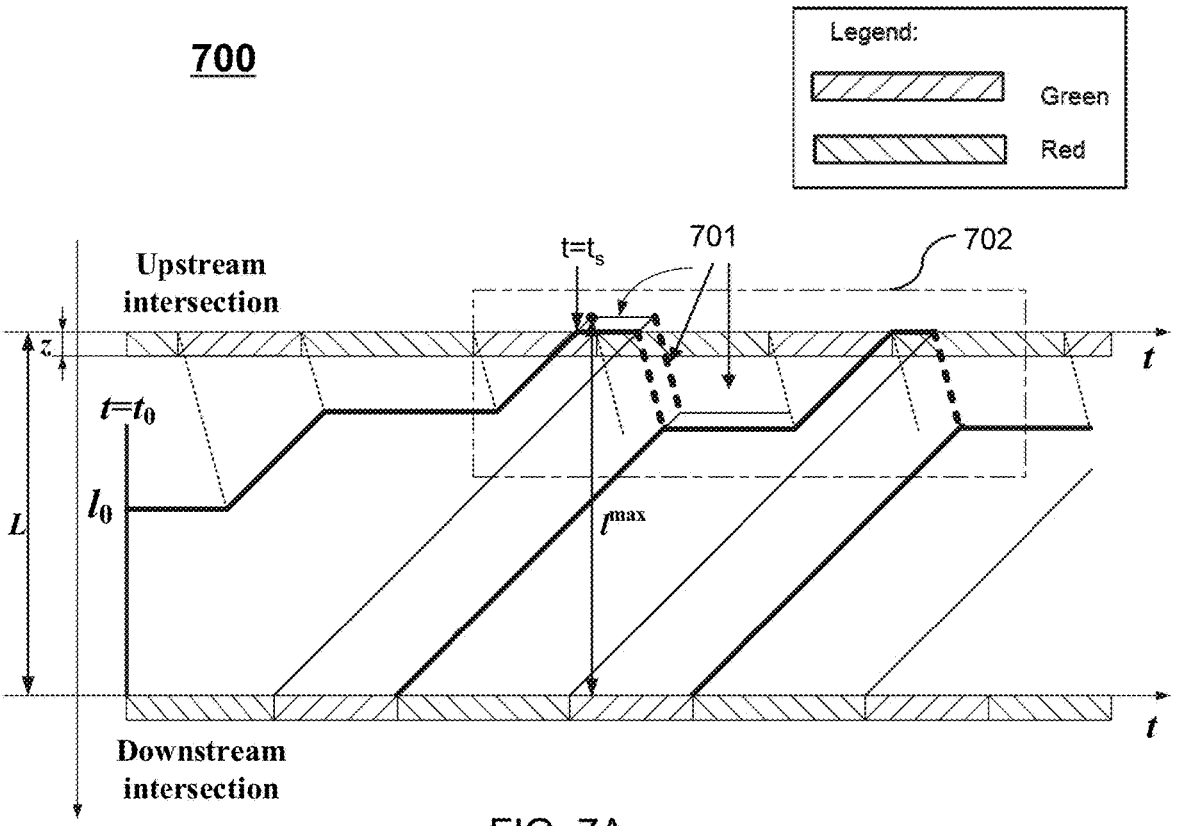
FIG. 7A is a schematic diagram illustrating exemplary queue length trajectories in spillover according to some embodiments of the present disclosure.

FIG. 7A is a schematic diagram illustrating exemplary queue length trajectories in spillover on one road according to some embodiments of the present disclosure. Similar to FIG. 6, FIG. 7A is a time-space diagram. As shown in FIG. 7A, L denotes the length of the road, which is the distance from upstream stop line to downstream stop line. z denotes the length of the upstream intersection. A first traffic light is at the downstream intersection. A second traffic light is at the upstream intersection.

As shown in FIG. 7A, the actual queue length trajectory on the road may be depicted by bold black lines, while the reference trajectory 701 on the road is also depicted for comparison. At time $t=t_s$, the queue trajectory may reach the stop line of the upstream intersection and the queue spills to the upstream and blocks the upstream intersection fully. The actual maximum queue length (i.e., $I_{max}$) that is equal to the road length (i.e., L) may be held until the discharge wave from downstream intersection reaches the upstream intersection when the traffic signal has already turned to red. It should be understood that once the spillover takes place on a particular road, on one hand, the spillover may spread backward along the road, i.e., vehicles from the upstream cannot enter the road near the end of the green light duration. On the other hand, the spillover may spread perpendicular to the road, i.e., vehicles from the cross street cannot pass the intersection at the beginning of their green-light duration (which is red-light duration for the described road). The spillover part of the time-space diagram may be denoted by a dashed box 702.

In some embodiments, a whole intersection spillover time (IST) may be divided into two distinct parts, a backward intersection spillover time (BIST) and a perpendicular intersection spillover time (PIST). The whole intersection spillover time may be described as follows:

$$\text{IST}=\text{BIST}+\text{PIST} \tag{10}.$$

Figure 7B:
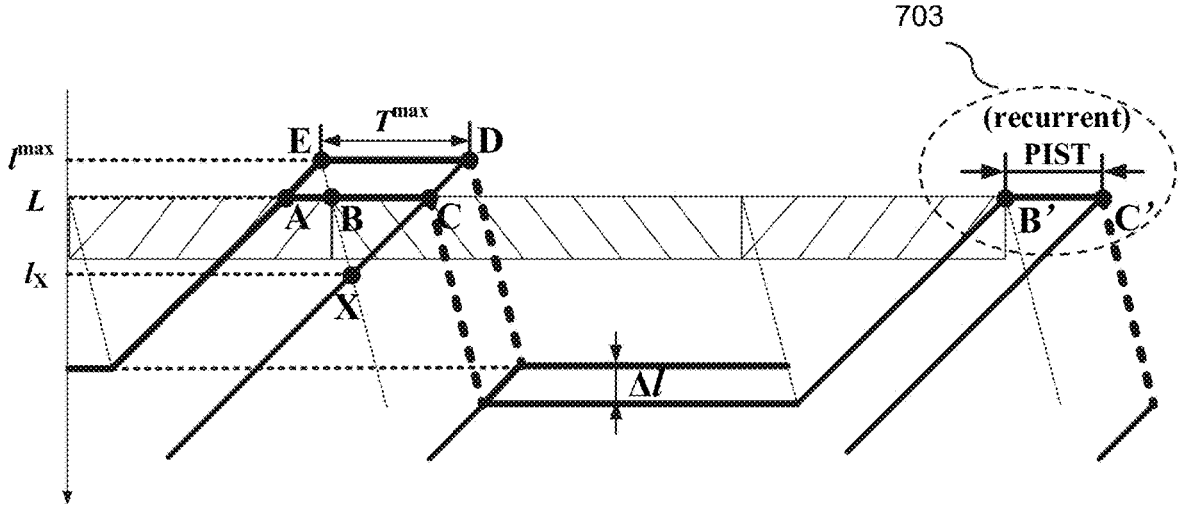
FIG. 7B is a schematic diagram illustrating an enlarged view of an exemplary queue length trajectories in spillover according to some embodiments of the present disclosure.

FIG. 7B is an enlarged view of the box 702 (i.e., spillover part) in FIG. 7A. As shown in FIG. 7B, it is easy to find that ACDE is a parallelogram. Consequently, the IST (indicated by the length of segment AC in FIG. 7B) is equal to $T^{max}$ (indicated by the length of segment DE in FIG. 7B), which may be determined in Equation (9), i.e., $$IST = T^{max} == \text{mod}(l_0, l_r) \cdot \frac{wv}{w+v}. \tag{11}$$

In this case, the length of AB indicates BIST, and the length of BC indicates PIST. According to the similarity of triangles EAB, XCB and XDE, BIST and PIST may be determined according to Equation (12) and Equation (13), respectively, as follows:

$$BIST = \frac{AB}{DE} \cdot IST = \frac{l^{max} - L}{l^{max} - l_X} T^{max}, \tag{12}$$

$$PIST = \frac{BC}{DE} \cdot IST = \frac{L - l_x}{l^{max} - l_X} T^{max}, \tag{13}$$

where X is the nearest crossover point to the upstream intersection that is on both the upstream red wave and downstream green wave simultaneously. A value of $l^{max}$ and a value of $T^{max}$ are given in Equations (8) and (9) above, and the position of X may be given by Equation (14) as follows:

$$l_X = l_g + (l_g + l_r) \cdot \text{floor}\left(\frac{l_0}{l_r}\right). \tag{14}$$

In some embodiments, the BIST may be equal to zero; i.e., the IST is equal to the PIST, for example, the dashed circle 703 as shown in FIG. 7B. PIST may be equal to the length of B'C'.

Figure 8A:
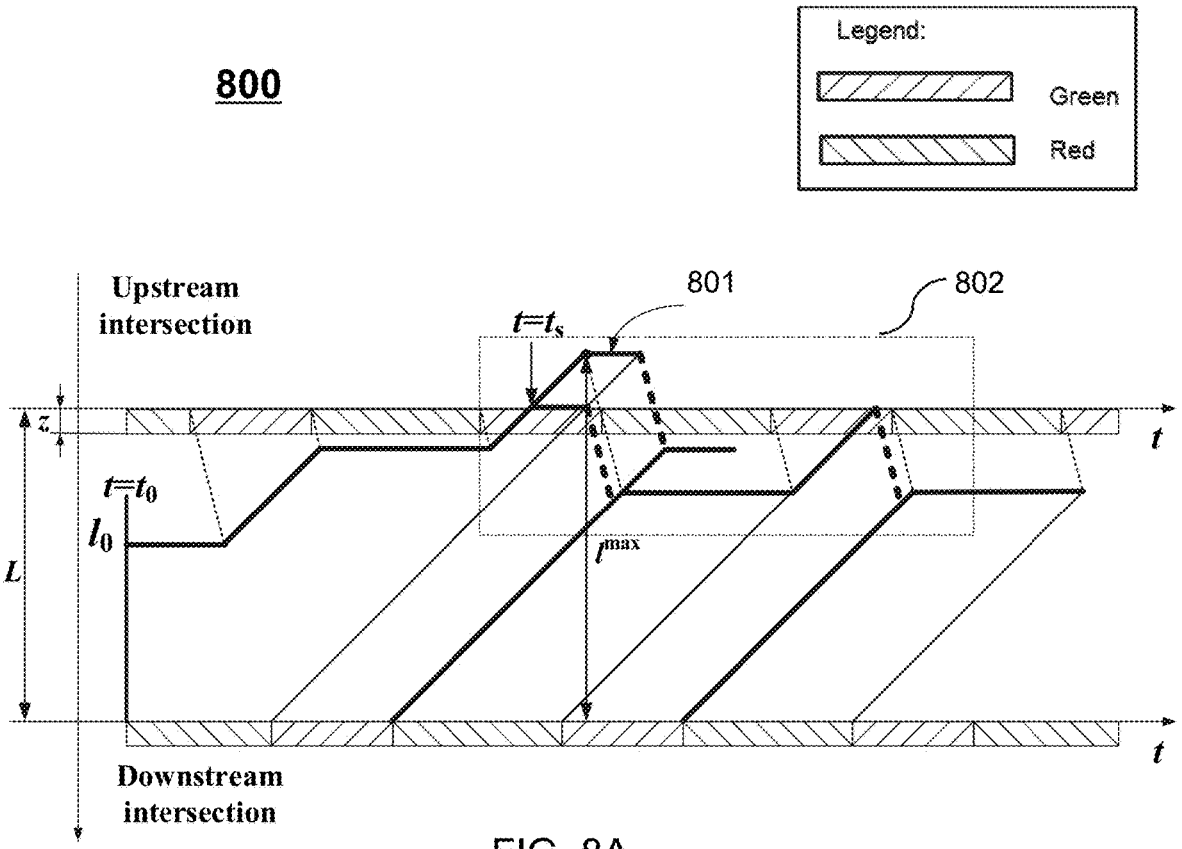
FIG. 8A is a schematic diagram illustrating exemplary queue length trajectories in spillover according to some embodiments of the present disclosure.
Figure 8B:
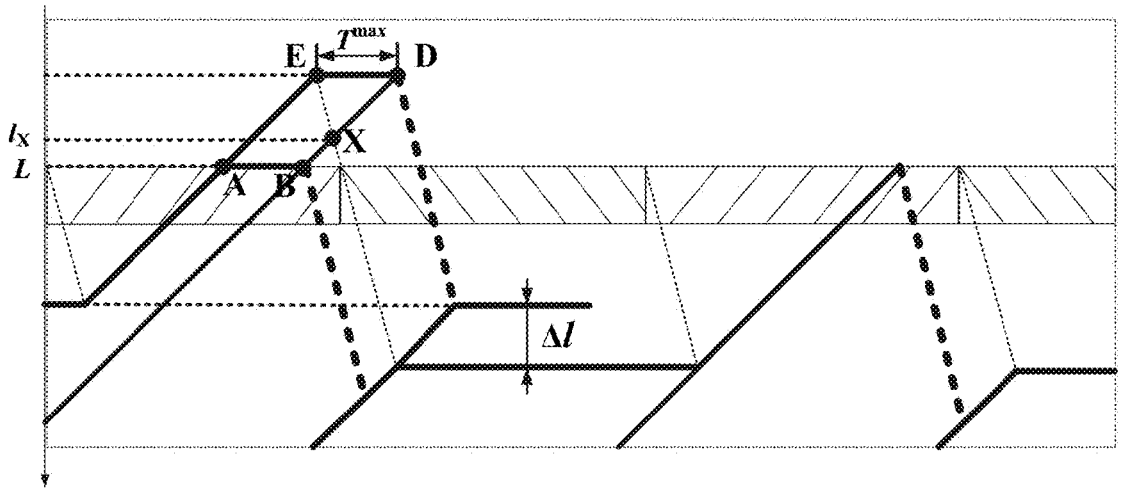
FIG. 8B is a schematic diagram illustrating an enlarged view of an exemplary queue length trajectories in spillover according to some embodiments of the present disclosure.

Nevertheless, the case as illustrated in FIG. 7A and FIG. 7B is not the only case. In some embodiments, the crossover point X is beyond the road length as shown in FIG. 8B. FIG. 8A is schematic diagram illustrating exemplary queue length trajectories in a spillover on one road according to some embodiments of the present disclosure, and FIG. 8B is an enlarged view of the spillover part 802 in FIG. 8A. In this case, when the discharge wave starting from downstream intersection reaches the upstream stop line during its green time, queues stopped at the upstream intersection are always able to be dissolved at the same green duration in which the queue reaches the upstream intersections. As a consequence, no PIST arises, and the perpendicular side street is not affected. For FIG. 8A, the expressions of BIST and PIST may be derived directly from Equations (15) and (16) as follows:

$$\text{BIST}=T^{max} \tag{15},$$

$$\text{PIST}=0 \tag{16}.$$

It should be noted that Equations (10) and (11) still hold for the case illustrated in FIG. 8A. For those skilled in the art, it should be understood that once the spillover takes place, some vehicles may not enter the road from the upstream intersection during a green light duration. The queue length in the next cycle may be smaller than its initial value. The difference, Δl, is determined by Equation (17) as follows:

$$\Delta l = \left\{ \begin{matrix} l^{max} - L, \text{ for } FIG.\ 7B \\ l^{max} - l_X, \text{ for } FIG.\ 8B \end{matrix} \right\} = BIST \cdot \frac{wv}{w+v}. \tag{17}$$

Afterward, the queue may be discharged and re-formed cyclically similar to that in FIG. 5. In some embodiments, it is easy to find that the queue length trajectory may converge to a new cyclic pattern whose maximum value is equal to the road length. Moreover, although the queues reach the upstream stop line every cycle, the queues may not block the inflow traffic from the upstream. For example, as shown in FIG. 7A, the queue length may be equal to the maximum value (i.e., the length of the road L) at the end of a green light duration. As another example, as shown in FIG. 8A, the queue may be dissolved immediately after the queue length reaches the maximum value, $l^{max}$ Consequently, there is no BIST in the further cycles.

For FIG. 7A, as long as the queued vehicles occupy the upstream intersection at the end of a green light time, a PIST may take place. The value of the PIST may be determined by a relative time within a cycle when the discharge wave from the downstream intersection reaches the upstream intersection, which remain unchanged in every cycle. Therefore, the length of B'C' may be equal to the length of BC in FIG. 7B. Once a PIST takes place, it may persist with a constant value in every future cycle as long as demands are sufficient and vehicles keep pouring in. Comparing the case as shown in FIG. 7A and the case as shown in FIG. 8A, a relative time within a cycle when the discharge wave from the downstream intersection reaches the upstream stop line is a critical character of a road that determines whether a PIST will occur and persist. In some embodiments, to prevent or reduce gridlock, the processor may control one or more traffic lights of the intersections such that the discharge wave from the downstream intersection reaches the upstream stop line during a green light duration. In other words, the processor may make the relative time within a cycle when the discharge wave from the downstream intersection reaches the upstream stop line be less than the green light duration. In some embodiments, the processor may adjust the time duration of a traffic light based on the relative time and make sure the downstream intersection reaches the upstream stop line during a green-light duration of the adjusted traffic light. More descriptions about how to adjust the traffic light may be found elsewhere in the present disclosure (e.g., FIG. 9 and the descriptions thereof).

Figure 9:
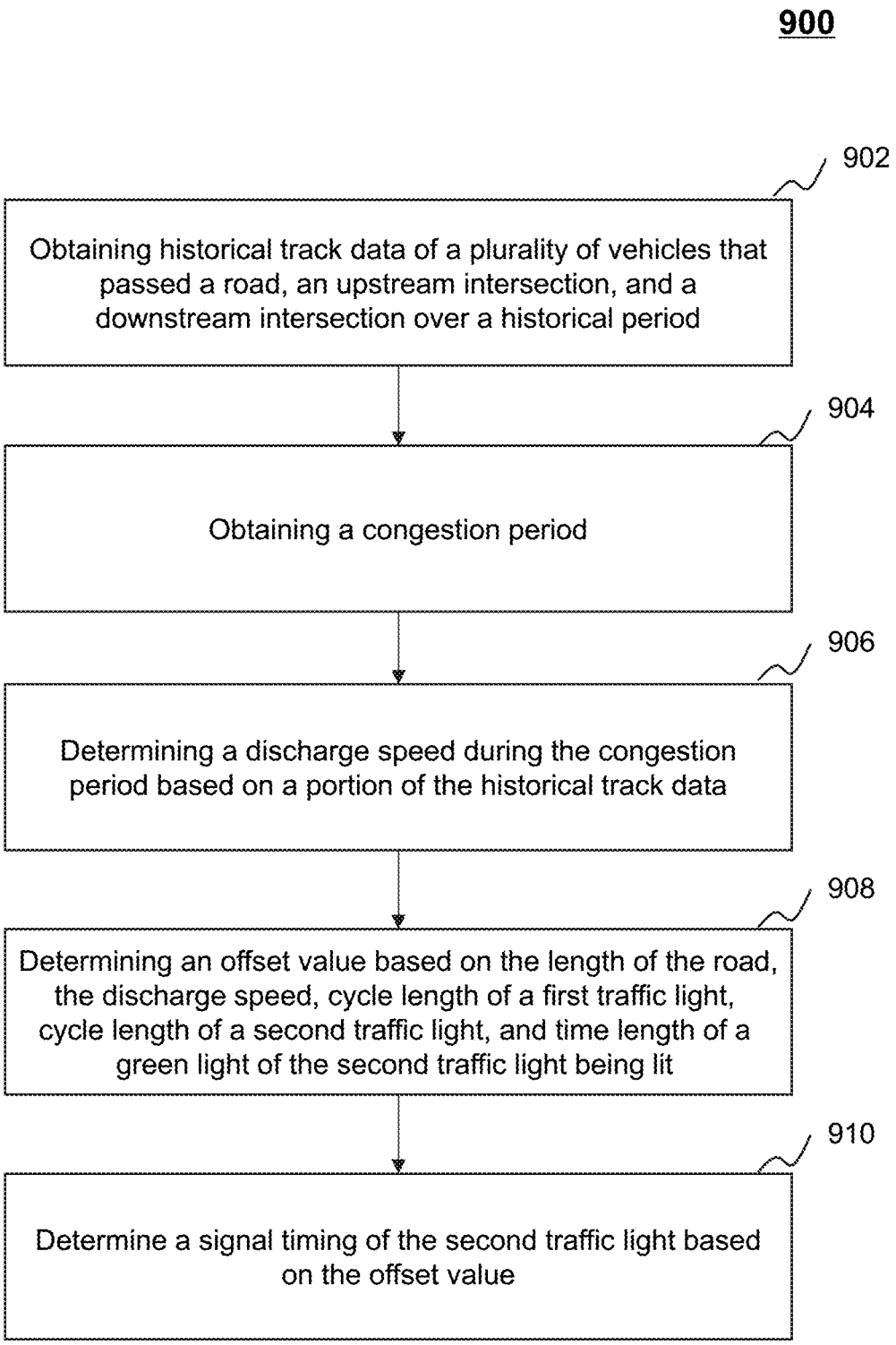
FIG. 9 is a flowchart illustrating an exemplary process for controlling traffic lights according to some embodiments of the present disclosure.

FIG. 9 is a flowchart illustrating an exemplary process for controlling traffic lights according to some embodiments of the present disclosure. In some embodiments, the process 900 may be implemented in the system 100. For example, the process 900 may be stored in the storage device 130 and/or the storage (e.g., the ROM 230, the RAM 240, etc.) as a form of instructions, and invoked and/or executed by the server 110 (e.g., the processing engine 112 in the server 110, or the processor 220 of the processing engine 112 in the server 110).

In 902, the processor (e.g., the acquisition module 410 of the processing engine 112) may obtain historical track data of a plurality of vehicles that passed a road, an upstream intersection, and a downstream intersection over a historical period. The road may connect the upstream intersection and the downstream intersection. For example, as shown in FIG. 5, a road 502 connects the upstream intersection A and the downstream intersection B. The plurality of vehicles may flow from the upstream intersection A to the downstream intersection B along the road 502. In some embodiments, a positioning system (e.g., the GPS system) of at least one of the plurality of vehicles may transmit its track data to the storage device 130 via the network 140. In some embodiments, the positioning system may be integrated into a mobile terminal (e.g., the driver terminal 120). The mobile terminal may transmit the track data to the storage device 130. The acquisition module 410 may further obtain historical track data of the plurality of vehicles over a historical period. The historical track data may include spatial information and time information associated with the plurality of vehicles. For example, the spatial information may include positions of the plurality of vehicles on the road 502. The time information may include corresponding time points when the plurality of vehicles at the positions, and traffic light data of an intersection (e.g., a green light duration, a red light duration), etc. The historical period may include a predetermined period, for example, an hour, a day, a week, a month, etc. The processor (e.g., the processing engine 112) may process the historical track data based on the spatial information and time information associated with the plurality of vehicles. For example, the processing engine 112 may determine a space-time diagram using the spatial information and time information.

In 904, the processor (e.g., the acquisition module 410) may obtain a congestion period. In some embodiments, the congestion period is a predetermined period according to experience (e.g., rush hours of workdays), for example, 7:00 a.m. to 9:00 a.m. In some embodiments, the processor may obtain the predetermined congestion period from storage (e.g., the storage device 130). For example, the user may predetermine a congestion period via a terminal (e.g., a mobile phone). Then the predetermined congestion period may be stored in the storage device 130. The acquisition module 410 may obtain the predetermined congestion period from the storage device 130.

In some embodiments, the processor (e.g., the acquisition module 410) may obtain the congestion period based on the historical track data of a plurality of vehicles. For example, the processing engine 112 may determine a queue length of the vehicles between two adjacent intersections, i.e., the upstream intersection and the downstream intersection, based on the historical track data of the plurality of vehicles. The processing engine 112 may determine the congestion period based on the queue length. The acquisition module 410 may obtain the determined congestion period. Assuming that, during a time period (t1~t2), if the queue length of the vehicles is greater than a threshold (e.g., the road length between the upstream intersection and the downstream intersection), or the queue spill to an adjacent road, the processing engine 112 may determine that the period (t1~t2) is the congestion period. For another example, the processing engine 112 may determine the congestion period based on the average passing speed of a plurality of vehicles that passed the road. The acquisition module 410 may obtain a passing time of the vehicle when it passes through the road based on the historical track data. The processing engine 112 may further determine the passing speed of each of the plurality of vehicles that passed the road based on the road length and corresponding passing time of the each of the plurality of vehicles. The processing engine 112 may determine the average passing speed by dividing a sum of the corresponding passing speed of each vehicle by the number of the plurality of the vehicles. If the average passing speed of the plurality of vehicles during a period (t3~t4) is slow, for example, the average passing speed is less than a value (e.g., 5 km/h, 10 km/h), the processing engine 112 may determine that the period (t3~t4) is the congestion period.

In some embodiments, the processor (e.g., the acquisition module 410) may obtain the congestion period from a third party database (e.g., a map service provider, an official transport database), for example, rush hours in the morning or afternoon.

Figure 10:
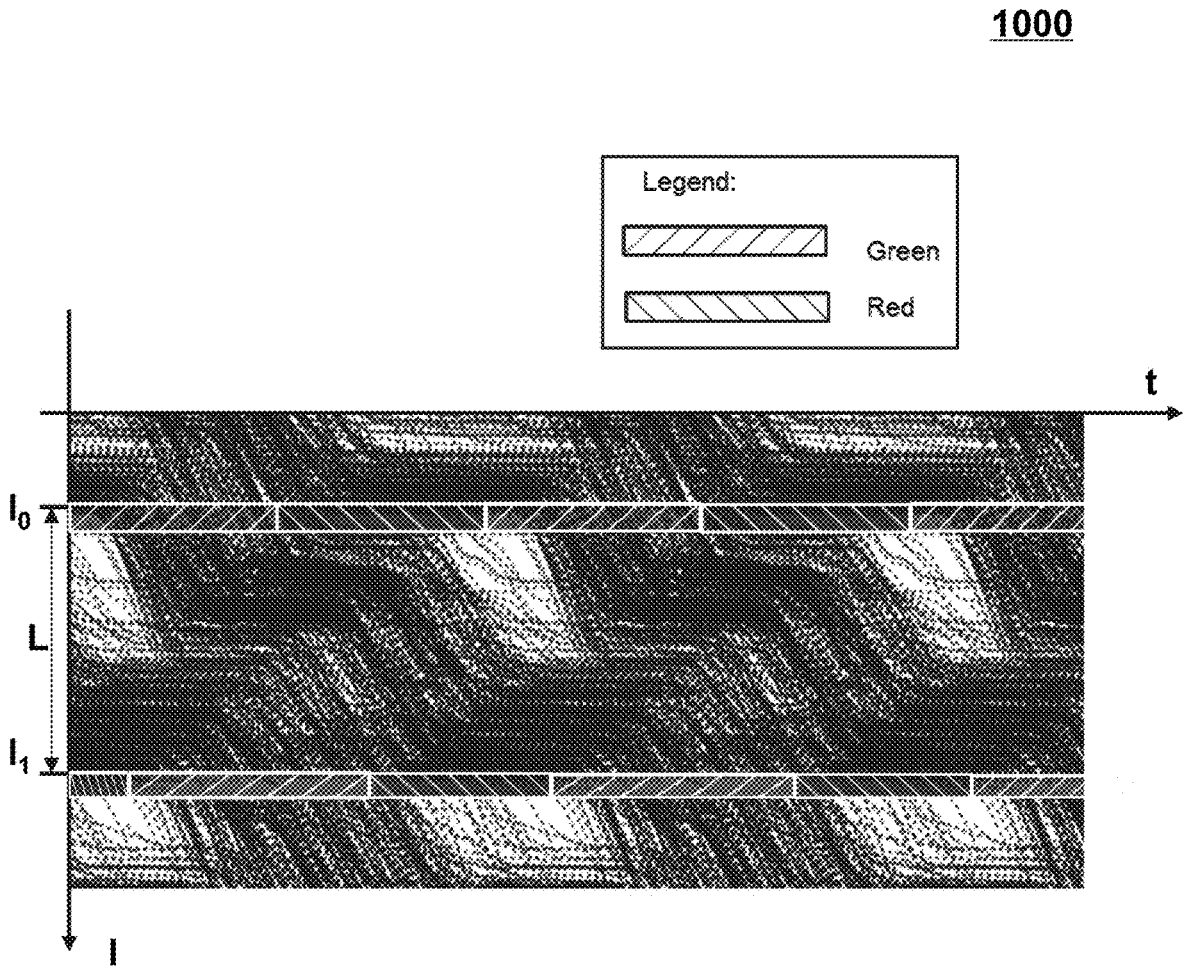
FIG. 10 is a schematic diagram illustrating an exemplary time-space diagram according to some embodiments of the present disclosure.

Merely for illustration, the processor may process the historical track data of the plurality of vehicles to generate a time-space diagram as illustrated in FIG. 10. FIG. 10 is a schematic diagram illustrating exemplary time-space diagram according to some embodiments of the present disclosure. The processor may determine the time-space diagram based on the historical track data of the plurality of vehicles. As shown in FIG. 10, the horizontal axis of the time-space diagram denotes a time, which is represented by t. The vertical axis of the time-space diagram denotes a position of a vehicle, which is represented by l. For example, $l_0$ denotes the position of the upstream intersection, $l_1$ denotes the position of the downstream intersection. The distance between the upstream intersection and the downstream intersection is denoted by L. The dashed line denotes a historical trajectory line of a vehicle, which is determined based on its historical track data. The processor may convert the historical track data of the plurality of vehicles into corresponding trajectory lines.

In some embodiments, the processor may determine whether a period is a congestion period. For example, as shown in FIG. 10, the time-space diagram may include the historical trajectories of a plurality of vehicles at a plurality of cycles. Each line represents the track of a vehicle over time. A cycle may include a green-light duration and a red-light duration. In some embodiments, the processor may determine the congestion period based on the time-space diagram. For example, if a portion of a trajectory line is flat in the time-space diagram, the corresponding vehicle is considered to be still over the period corresponding to the flat portion of the trajectory line. The processor may obtain a stop position of the last queued vehicle on the road at a period from the time-space diagram. The position corresponding to the flat portion of the trajectory line may be designated as the stop position. The processor may determine whether the stop position of the last queued vehicle is beyond the stop line of the upstream intersection. If the stop position of the last queued vehicle is beyond the stop line of the upstream intersection at a period, the processor may determine that the period is the congestion period.

In some embodiments, the processor may determine a passing time period of each of a plurality of vehicles that passes a road according to the time-space diagram. For example, the processor may obtain a start time point when the vehicle passes the upstream intersection, and/or a finishing time point when the vehicle passes the downstream intersection. The start time point refers to the time point corresponding to the start point of the trajectory of a vehicle. The finishing time point refers to the time point corresponding to the finishing point of the trajectory of the vehicle. The processor may determine the time duration between the start time point and the finishing time point as the passing time period of the vehicle. The processor may also determine the passing speed of each of the plurality of vehicles that passes the road based on the road length and corresponding passing time period of the each of the plurality of vehicles. The processor may further determine the average passing speed based on the determined passing speeds of the vehicles. If the average passing speed of the plurality of vehicles during a period is slow, for example, the average passing speed is less than a value (e.g., 5 km/h, 10 km/h), the processor may determine that the period is the congestion period.

In 906, the processor (e.g., the discharge speed determination module 420) may determine a discharge speed during the congestion period based on a portion of the historical track data. The portion of the historical track data refers to historical track data of the plurality of vehicles during the congestion period (e.g., 7:00 a.m. to 9:00 a.m. on a workday). For example, the acquisition module 410 may obtain historical track data of a plurality of vehicles that passed through an intersection (e.g., the downstream intersection B shown in FIG. 5) along the east-to-west flow direction during the congestion period of each workday. The discharge speed determination module 420 may further map the portion of historical track data to a cycle duration on a time-space diagram. For example, as illustrated in FIG. 13A, the historical track data of the plurality of vehicles, which passed through the same intersection at a certain period every day, are mapped to the time-space diagram. Each trajectory corresponding to the historical track data of each of the plurality of vehicles on the time-space diagram may be in a cycle duration of traffic light of the intersection (e.g., the downstream intersection B as shown in FIG. 5). The period, 0~r1, refers to a red-light duration, and the period, r1~g1, refers to a green-light duration. More descriptions about how to map the historical track data to a cycle duration on a time-space diagram may be found elsewhere in the present disclosure (e.g., FIGS. 11-12, FIG. 13A and FIG. 13B, and the descriptions thereof).

In some embodiments, the processor may determine a relative start time point of each of a plurality of first vehicles based on the historical track data. The first vehicles may include the vehicles that started to move from a stop condition and crossed the boundary between the road and the downstream intersection during one period of the green light of the first traffic light being lit. For example, the processor may obtain an actual start time point of each of the plurality of first vehicles, and a start time point of the period of the green light of the first traffic light being lit. The processor may further determine the relative start time point based on the actual start time point of the first vehicle and the start time point of the period of the green light of the first traffic light being lit. For example, the actual start time point of the first vehicle is at a time point A. The start time point of the period of the green light of the first traffic light is at a time point B. Given that the discharge wave may start to propagate backward to the upstream with a discharge speed at the start time point of the period of the green light of the first traffic light, the time point A is later than the time point B. The processor may determine a relative time length of the first vehicle based on the difference between the time point A and the time point B (i.e., A−B). In a cycle duration, the start time point of the green light may be designated as a reference time point (e.g., r1 as shown in FIG. 13A or FIG. 13B). The relative start time point of the first vehicle may be determined based on the reference time point and the relative time length of the first vehicle, for example, the relative time point of the first vehicle is r1+(A−B). More descriptions about how to determine the relative start time point may be found elsewhere in the present disclosure (e.g., FIG. 12 and the descriptions thereof).

The processor may determine the discharge speed based on the relative time points of the plurality of first vehicles. For example, the processor may determine the corresponding positions of the plurality of first vehicles at the relative time points. The processor may further determine the discharge speed based on the relative time points of the plurality of first vehicles and the corresponding positions of the plurality of first vehicles at the relative time points. For example, the processor may fit track points corresponding to the relative start time points and the corresponding positions to a straight line based on a linear fitting method (e.g., the fitted straight line 1322 shown in FIG. 13B). A track point corresponding to the relative start time point and the corresponding position is also referred to herein as a discharging point (e.g., the discharging point 1321 shown in FIG. 13B). The processor may determine the slope of the fitted straight line as the discharge speed.

In 908, the processor (e.g., the offset value determination module 430) may determine an offset value of the second traffic light relative to the first traffic light based on the length of the road, the discharge speed, the cycle length of the first traffic light, the cycle length of a second traffic light, and the time length of the green light of the second traffic light being lit. The second traffic light refers to a traffic light at the upstream intersection, and the first traffic light refers to a traffic light at the downstream intersection. As used herein, the offset value of the second traffic light relative to the first traffic light refers to a difference value between a start time point of light-cycle of the first traffic light, and a corresponding start time point of light-cycle of the second traffic light (considering that the cycle lengths of the first traffic light and the second traffic light are same). For example, at about 9:00 in the morning, the green light of the first traffic light may start to being lit at 9:01, while the green light of the second traffic light may start to being lit at 9:02. The offset value of the second traffic light relative to the first traffic light is the difference between the two time points; that is, 1 minute. For controlling the queue spillover, it is desired to let the discharge wave from the downstream intersection reaches a stop line of the upstream intersection during the time duration of the green light of the second traffic light being lit. The processor may determine the offset value of the second traffic light relative to the first traffic light, such that the discharge wave from the downstream intersection reaches a stop line of the upstream intersection during the time duration of the green light of the second traffic light. In some embodiments, the processor may further determine the offset value of the second traffic light relative to the first traffic light based on a relative time within a cycle at which the discharge wave from downstream intersection reaches upstream stop line. In some embodiments, the relative time may be determined based on Equation (18) as follows:

$$t_i = \mathrm{mod}\left(\delta_i + \frac{L_i}{\omega_i}, c\right), \tag{18}$$

where $t_i$ denotes the relative time within a cycle at which the discharge wave from downstream intersection reaches upstream stop line for a road i, $\delta_i$ denotes the offset value, $L_i$ denotes the length of the road i, $\omega_i$ denotes the discharge speed, c denotes a cycle length of a traffic light, and function mod (x,y) is the reminding after dividing x by y. The length of the road $L_i$ may include the length of the upstream intersection. For example, as shown in FIG. 6, the road length L includes the length of the upstream intersection z. In some embodiments, the cycle length of the first traffic light may be equal to the cycle length of the second traffic light. To prevent or reduce the gridlock, the processor may adjust the offset value to ensure relative time $t_i$ is less than the time length of a green light of the second traffic light being lit. The time length of green light of the second traffic light being lit is represent by $g_i$. The processor may further determine the offset value $\delta_i$ based on inequality (19) as follows:

$$\mathrm{mod}\left(\delta_i + \frac{L_i}{\omega_i}, c\right) - g_i < 0, \tag{19}$$

where $g_i$ denotes the time length of green light of the second traffic light being lit. There may be an offset value range that all offset values included in the offset value range may satisfy the inequality (19). For example, the solution of the offset value range, and $\delta_i \in [0, c)$. In some embodiments, the offset value determination module 430 may obtain the length of the road $L_i$, the discharge speed $\omega_i$, the cycle length of the traffic light c, and $g_i$ from a storage device (e.g., the storage device 130). The processor may further determine the offset value based on the determined offset value range. For example, the offset value may be a value within the determine offset value range.

In 910, the processor (e.g., the adjustment module 440) may determine a signal timing of the second traffic light based on the offset value. The signal timing of a traffic light refers to a periodical rule of a plurality of repeated cycles of a traffic light being lit. A cycle of a traffic light may include a green-light duration and a red-light duration. The green-light duration may be a constant value (e.g., $g_0$), and the red-light duration may be a constant value (e.g., $r_0$).

In some embodiments, at a start time point of the congestion period, the processor may determine the signal timing of the second traffic light by control the second traffic light to delay for the offset value relative to the first traffic light. For example, as illustrated in FIG. 14, if the start time point of the congestion period congestion is in a first cycle, the processor may control the signal timing of the second traffic light to delay the offset value relative to the first traffic light. The first time duration of the red light of the second traffic light is a sum of the original time duration of the red light $r_0$ and the offset value $\delta_i$, i.e., $r_0+\delta_i$. Accordingly, the start time of the second cycle of the second traffic light is later than the original start time of the second cycle of the second traffic light. For the congestion period, the second traffic light may utilize the signal timing to prevent or reduce the gridlock.

In some embodiments, the processor may determine the signal timing of the second traffic light based on a first time point that the green light of the first traffic light starts to be on for a first time and the offset value. More specifically, the processor may determine a first time point that the green light of first traffic light starts to be lit for a first time. The processor may determine a second time point that the green light of the second traffic light starts to be lit, based on the first time point and the offset value. For example, the second time point may be equal to a sum of the first time point and the offset value. The processor may extend a period of red light of the second traffic light to the second time point. Then processor may cause the green light of the second traffic light to be lit at the second point.

Figure 11:
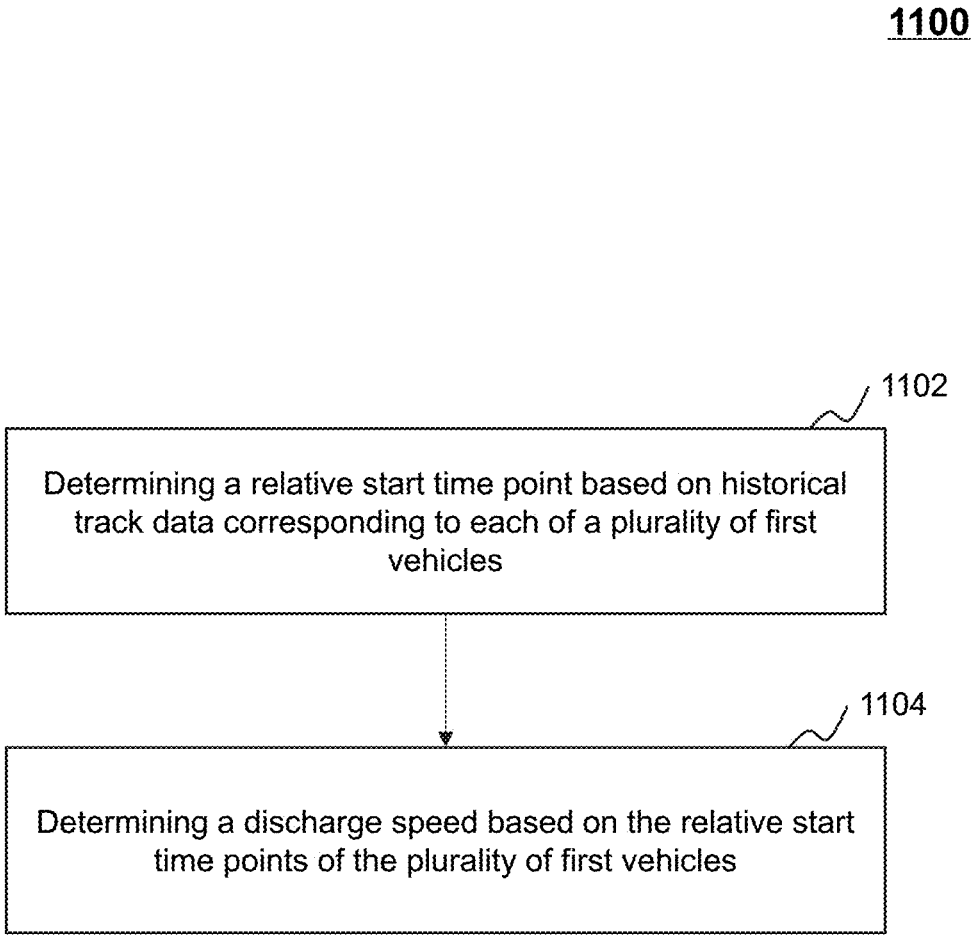
FIG. 11 is a flowchart illustrating an exemplary process for determining a discharge speed according to some embodiments of the present disclosure.

FIG. 11 is a flowchart illustrating an exemplary process for determining a discharge speed according to some embodiments of the present disclosure. In some embodiments, the process 1100 may be implemented in the system 100. For example, the process 1100 may be stored in the storage device 130 and/or the storage (e.g., the ROM 230, the RAM 240, etc.) as a form of instructions, and invoked and/or executed by the server 110 (e.g., the processing engine 112 in the server 110, or the processor 220 of the processing engine 112 in the server 110).

In 1102, the processor (e.g., the discharge speed determination module 420) may determine a relative start time point based on historical data corresponding to each of a plurality of first vehicles. The first vehicles may include the vehicles that started to move from a stop condition and crossed the downstream stop line of the road during one period of the green light of the first traffic light being lit. The first traffic light may be the traffic light being at the downstream intersection. The historical track data may include positions of the plurality of first vehicles on the road and corresponding time points at which the plurality of first vehicles at the positions. In some embodiments, the processor may obtain the actual start time of the first vehicle based on historical track data of the first vehicle. The process may obtain a start time point of the period of the green light of the first traffic light being lit. The processor may further determine the relative start time point based on the actual start time point of the each of the plurality of first vehicles and the start time point of the period of the green light of the first traffic light being lit. For example, the discharge speed determination module 420 may designate the start time point of the green light being lit as a reference time point. The discharge speed determination module 420 may also designate the difference between the actual start time point of the first vehicle and the start time point of the green light as a relative time length. The discharge speed determination module 420 may further determine the relative start time point based on the reference time point and the relative time length. For example, the actual start time point of the first vehicle is at a time point A. The start time point of the period of the green light of the first traffic light is at a time point B. Given that the discharge wave may start to propagate back to the upstream with a discharge speed at the start time point of the period of the green light of the first traffic light, the time point A is later than the time point B. The processor may determine a relative time length of the first vehicle based on the difference between the time point A and the time point B (i.e., A−B). In a cycle duration, the start time point of the green light may be designated as a reference time point (e.g., r1 as shown in FIG. 13A or FIG. 13B). The relative start time point of the first vehicle may be determined based on the reference time point and the relative time length of the first vehicle, for example, the relative time point of the first vehicle is r1+(A−B). At the relative start time point, the vehicle starts to move. The relative start time point may correspond to a discharging point, which refers to a track point where the corresponding vehicle starts to move from a stop condition, such as the discharging point 1321 as shown in FIG. 13B.

In 1104, the processor (e.g., the discharge speed determination module 420) may determine a discharge speed based on the relative start time points of the plurality of first vehicles. More specifically, the processor may determine the discharge speed based on the relative start time points of the plurality of first vehicles and the corresponding positions of the vehicles at the relative start time points.

The time points when the plurality of first vehicles passed the road may not be in the same cycle. For example, as shown in FIG. 10, the sampled historical trajectories of the plurality of vehicles may not be in the same cycle. The processor may map the sampled historical trajectory in different cycles to the same cycle. For example, as shown in FIG. 13A, the sampled historical trajectories in different cycles are mapped to a single cycle on the time-space diagram. The horizontal axis of the time-space diagram represents relative time points of the first vehicles, while the vertical axis of the time-space diagram represents the positions of the first vehicles at various relative time points. In other words, the processor may map the sampled historical trajectory in different cycles to the same cycle based on the relative time points and the corresponding positions of the first vehicles at the relative time point. For example, in a Monday morning around 9:00 am, a blue car passed the downstream intersection during a cycle of the first traffic light between 9:00:10 a.m. to 9:00:50 a.m. In a Friday morning around 8:00 am, a yellow car passed the downstream intersection during a cycle of the first traffic light between 8:00:00 a.m. to 8:00:40 a.m. The processor may map the historical trajectory of the blue car in Monday morning and the historical trajectory of the yellow car in the Friday morning to the same cycle of a traffic light with a cycle length of forty seconds. As shown in FIG. 13A, a plurality of trajectory points of the plurality of first vehicles started to move from a stop condition may be distributed around a straight line starting from the start time of the green light in the cycle, for example, the straight line 1320. In some embodiments, the processor may determine the discharge speed based on the straight line.

Merely for illustration, as illustrated in FIG. 13B, the time-space diagram in FIG. 13B is similar to the time-space diagram in FIG. 13A. The horizontal axis of the time-space diagram represents relative time points of the first vehicles, while the vertical axis of the time-space diagram represents the positions of the first vehicles at various relative time points. The processor may determine a series of discharging points of the plurality of first vehicles that correspond to the relative start time points of the plurality of first vehicles. For example, the processor may determine a discharging point 1321 corresponding to the relative start time point t1. Furthermore, the processor may fit the plurality of discharging points (e.g., the discharging point 1321) to a line based on a linear fitting method, for example, the fitted straight line 1322. In some embodiments, the processor may determine the slope of the fitted line as the discharge speed. The exemplary linear fitting method may include a least square method, an interpolation method, or the like, or any combination thereof. The exemplary interpolation method may include a Lagrange interpolation method, a Newton interpolation method, a Spline interpolation method, etc. It is understood for persons having ordinary skills in the art that the way of fitting discharging points may be varied. All such variations are within the protection scope of the present disclosure.

Figure 12:
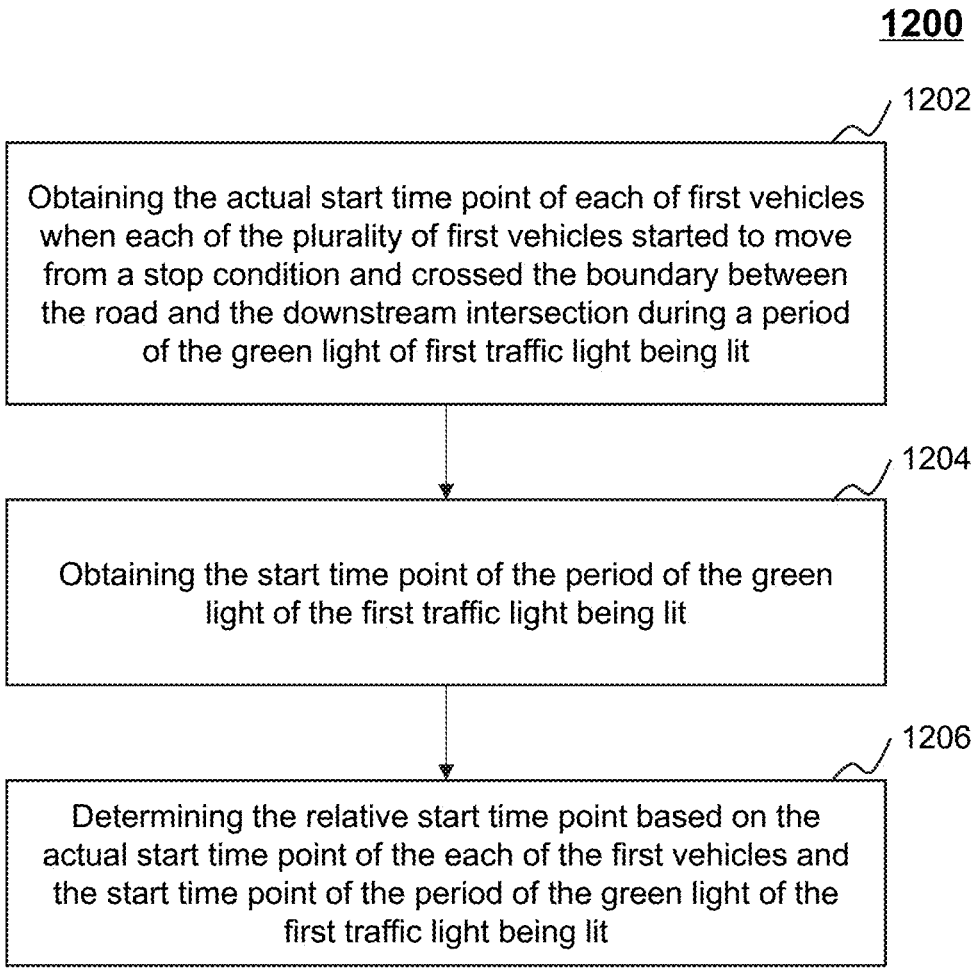
FIG. 12 is a flowchart illustrating an exemplary process for determining a relative start time point according to some embodiments of the present disclosure.
Figure 13A:
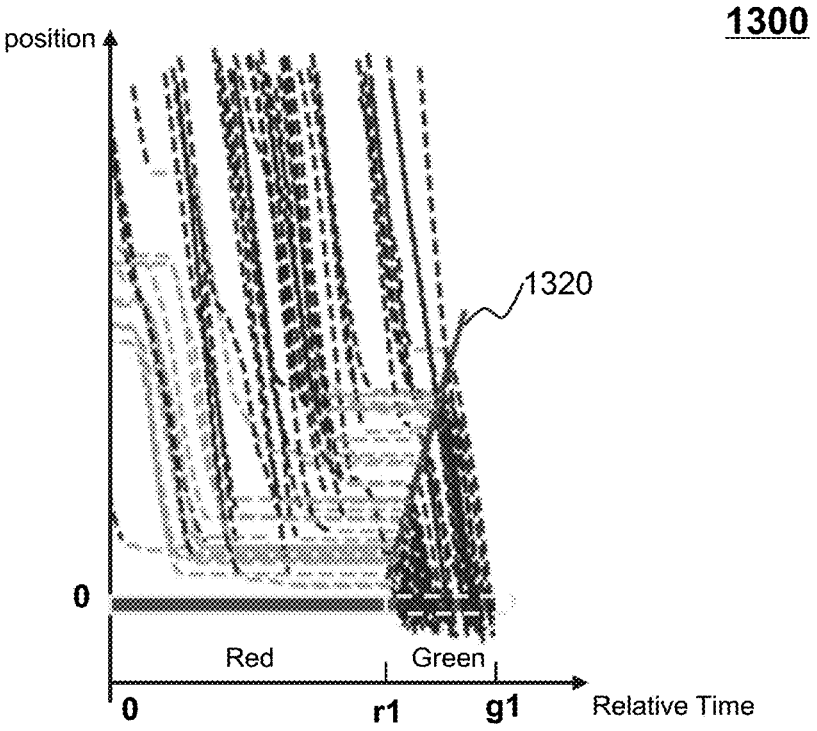
FIG. 13A is a schematic diagram illustrating an exemplary time-space diagram according to some embodiments of the present disclosure.
Figure 13B:
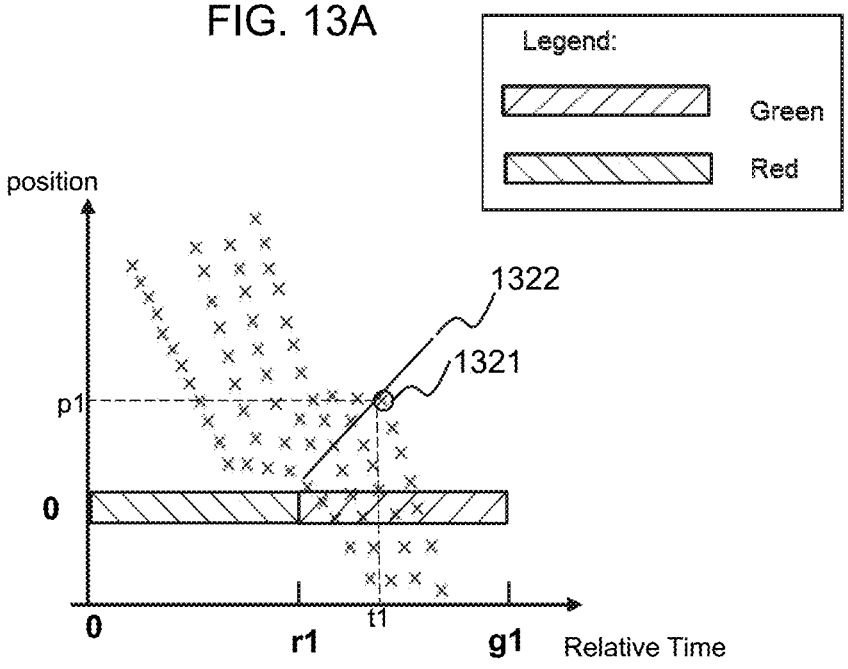
FIG. 13B is a schematic diagram illustrating an exemplary time-space diagram according to some embodiments of the present disclosure.

FIG. 12 is a flowchart illustrating an exemplary process for determining a relative start time point according to some embodiments of the present disclosure. In some embodiments, the process 1200 may be implemented in the system 100. For example, the process 1200 may be stored in the storage device 130 and/or the storage (e.g., the ROM 230, the RAM 240, etc.) as a form of instructions, and invoked and/or executed by the server 110 (e.g., the processing engine 112 in the server 110, or the processor 220 of the processing engine 112 in the server 110).

In 1202, the processor may obtain an actual start time point of each of a plurality of first vehicles when each of the plurality of first vehicles started to move from a stop condition and crossed the boundary between the road and the downstream intersection during a period of the green light of first traffic light being lit. The first traffic light may be a traffic light at the downstream intersection. The boundary between the road and the downstream intersection may be a stop line of the downstream intersection (herein also referred to as the downstream intersection). The processor may obtain the actual start time of a first vehicle from historical track data of that first vehicle. The historical track data of a first vehicle may include the positions of the first vehicle at various time points. For example, the processor may obtain a historical track point where the first vehicle started to move from a stop condition. The processor may obtain the actual start time of the first vehicle based on the historical track point.

In 1204, the processor may obtain a start time point of the period of the green light of the first traffic light being lit. In some embodiments, the acquisition module 410 may obtain the start time point of the green light of the first traffic light using a loop detector on the road. The loop detector may detect the time information of the first traffic light, for example, the start time point of the green light or the red light and the time duration of the green light or red light being lit. In some embodiments, the processor may obtain the start time point of the green light of the first traffic light from a database (e.g., an official transport database).

In 1206, the processor may determine the relative start time point based on the actual start time point of the each of the plurality of first vehicles and the start time point of the period of the green light of the first traffic light being lit. For example, the discharge speed determination module 420 may designate the start time point of the green light being lit as a reference time point. The discharge speed determination module 420 may also designate the difference between the actual start time point of the first vehicle and the start time point of the green light as a relative time length. The discharge speed determination module 420 may determine the relative start time point based on the reference time point and the relative time length (e.g., based on the descriptions in 906).

Figure 15:
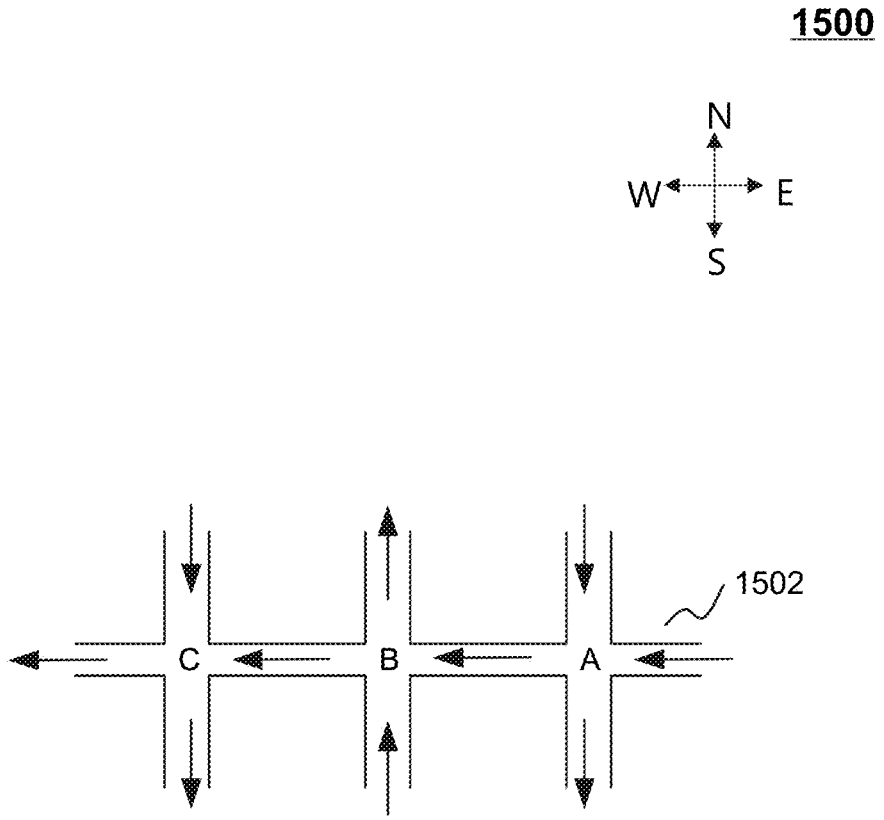
FIG. 15 is a schematic diagram illustrating an exemplary one-way road network including multiple intersections according to some embodiments of the present disclosure.

The process 900 as illustrated in FIG. 9 may also be applied to a road network including a plurality of intersections along a road (e.g., as shown in FIG. 15). As shown in FIG. 15, the road 1502 may include three intersections, namely, A, B, and C. A first traffic light may be at intersection A, a second traffic light may be at intersection B, and a third traffic light may be at intersection C. In some embodiments, at the congestion period, the downstream queue spillover may spread to a plurality of intersections. For example, the queue between intersection C and the intersection B may spread to intersection B and intersection A. The spillover may cause the gridlock. To prevent or reduce the gridlock, the processor may further determine another offset value between intersection C and intersection B based on the methods disclosed in the present disclosure. Then, the processor may determine signal timings of the traffic lights of the intersection A and B based on their offset values respectively.

Having thus described the basic concepts, it may be rather apparent to those skilled in the art after reading this detailed disclosure that the foregoing detailed disclosure is intended to be presented by way of example only and is not limiting. Various alterations, improvements, and modifications may occur and are intended to those skilled in the art, though not expressly stated herein. These alterations, improvements, and modifications are intended to be suggested by this disclosure, and are within the spirit and scope of the exemplary embodiments of this disclosure.

Moreover, certain terminology has been used to describe embodiments of the present disclosure. For example, the terms "one embodiment," "an embodiment," and "some embodiments" mean that a particular feature, structure or characteristic described in connection with the embodiment is included in at least one embodiment of the present disclosure. Therefore, it is emphasized and should be appreciated that two or more references to "an embodiment" or "one embodiment" or "an alternative embodiment" in various portions of this specification are not necessarily all referring to the same embodiment. Furthermore, the particular features, structures or characteristics may be combined as suitable in one or more embodiments of the present disclosure.

Further, it will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, micro-code, etc.) or combining software and hardware implementation that may all generally be referred to herein as a "module," "unit," "component," "device," or "system." Furthermore, aspects of the present disclosure may take the form of a computer program product embodied in one or more computer-readable media having computer readable program code embodied thereon.

A computer readable signal medium may include a propagated data signal with computer readable program code embodied therein, for example, in baseband or as part of a carrier wave. Such a propagated signal may take any of a variety of forms, including electro-magnetic, optical, or the like, or any suitable combination thereof. A computer readable signal medium may be any computer readable medium that is not a computer readable storage medium and that may communicate, propagate, or transport a program for use by or in connection with an instruction execution system, apparatus, or device. Program code embodied on a computer readable signal medium may be transmitted using any appropriate medium, including wireless, wireline, optical fiber cable, RF, or the like, or any suitable combination of the foregoing.

Computer program code for carrying out operations for aspects of the present disclosure may be written in any combination of one or more programming languages, including an object-oriented programming language such as Java, Scala, Smalltalk, Eiffel, JADE, Emerald, C++, C #, VB. NET, Python or the like, conventional procedural programming languages, such as the "C" programming language, Visual Basic, Fortran 2003, Perl, COBOL 2002, PHP, ABAP, dynamic programming languages such as Python, Ruby, and Groovy, or other programming languages. The program code may execute entirely on the user's computer, partly on the user's computer, as a standalone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Furthermore, the recited order of processing elements or sequences, or the use of numbers, letters, or other designations, therefore, is not intended to limit the claimed processes and methods to any order except as may be specified in the claims. Although the above disclosure discusses through various examples what is currently considered to be a variety of useful embodiments of the disclosure, it is to be understood that such detail is solely for that purpose and that the appended claims are not limited to the disclosed embodiments, but, on the contrary, are intended to cover modifications and equivalent arrangements that are within the spirit and scope of the disclosed embodiments. For example, although the implementation of various components described above may be embodied in a hardware device, it may also be implemented as a software-only solution, e.g., an installation on an existing server or mobile device.

Similarly, it should be appreciated that in the foregoing description of embodiments of the present disclosure, various features are sometimes grouped together in a single embodiment, figure, or description thereof for the purpose of streamlining the disclosure aiding in the understanding of one or more of the various embodiments. This method of disclosure, however, is not to be interpreted as reflecting an intention that the claimed subject matter requires more features than are expressly recited in each claim. Rather, claim subject matter lie in less than all features of a single foregoing disclosed embodiment.

We claim:

1. A method implemented on a computing device for controlling traffic lights of an upstream intersection and a downstream intersection linked by a road, the computing device including a memory and processing circuits, the method comprising:

obtaining, from a server, signals including historical track data of a plurality of vehicles that passed the road, the upstream intersection, and the downstream intersection over a historical period;

obtaining signals including a congestion period;

determining, by the processing circuits, a discharge speed during the congestion period based on a portion of the historical track data, the portion of the historical track data being corresponding to the congestion period;

determining, by the processing circuits, an offset value based on a length of the road, the discharge speed, a cycle length of a first traffic light, a cycle length of a second traffic light, and a time length of a green light of the second traffic light being lit, the first traffic light being at the downstream intersection, the second traffic light being at the upstream intersection, the cycle length of the first traffic light being equal to the cycle length of the second traffic light; and determining, by the processing circuits, a signal timing of the second traffic light based on the offset value.

2. The method of claim 1, wherein the historical track data of the plurality of vehicles includes data of positions of the plurality of vehicles on the road and corresponding time points at which the plurality of vehicles at the positions.

3. The method of claim 2, wherein determining the discharge speed during the congestion period based on a portion of the historical track data corresponding to the congestion period includes:

for each of a plurality of first vehicles that pass through a boundary between the road and the downstream intersection during the congestion period, determining, by the processing circuits, a relative start time point based on historical track data corresponding to the each of the plurality of first vehicles; and determining, by the processing circuits, the discharge speed based on the relative start time points of the plurality of first vehicles.

4. The method of claim 3, wherein determining, for each of the plurality of first vehicles, the relative start timing based on the historical track data corresponding to the each of the plurality of first vehicles includes:

obtaining signals including an actual start time point of the each of the plurality of first vehicles that the each of the plurality of first vehicles started to move from a stop condition and across the boundary between the road and the downstream intersection during a period of the green light of the first traffic light being lit;

obtaining signals including a start time point of the period of the green light of the first traffic light being lit; and determining, by the processing circuits, the relative start time point based on the actual start time point of the each of the plurality of first vehicles and the start time point of the period of the green light of the first traffic light being lit.

5. The method of claim 3, wherein determining the discharge speed based on the relative start time points of the plurality of first vehicles further includes: determining, by the processing circuits, the discharge speed based on the relative start time points of the plurality of first vehicles and corresponding positions of the plurality of first vehicles at the relative time points.

6. The method of claim 1, wherein determining the offset value based on the length of the road, the discharge speed, the cycle length of the first traffic light, the cycle length of the second traffic light, and the time length of the green light of the second traffic light being lit includes:

determining, by the processing circuits, an offset value range based on the length of the road, the discharge speed, the cycle length of the first traffic light, the cycle length of the second traffic light, and the time length of the green light of the second traffic light being lit; and determining, by the processing circuits, the offset value based on the offset value range.

7. The method of claim 1, wherein the length of the road includes a length of the upstream intersection.

8. The method of claim 1, wherein determining the signal timing of the second traffic light based on the offset value includes:

controlling the second traffic light to delay for the offset value relative to the first traffic light corresponding to the congestion period.

9. The method of claim 1, wherein determining the signal timing of the second traffic light based on the offset value includes:

determining, by the processing circuits, a first time point that the green light of the first traffic light starts to be on for a first time;

determining, by the processing circuits, a second time point based on the first time point and the offset value;

extending a period of a red light of the second traffic light to the second time point; and lighting the green light of the second traffic light at the second time point.

10. A system for controlling traffic lights of an upstream intersection and a downstream intersection linked by a road, the system comprising:

at least one storage medium including a set of instructions; and processing circuits in communication with the at least one storage medium, wherein when executing the set of instructions, the processing circuits are directed to:

obtain signals including historical track data of a plurality of vehicles that passed the road, the upstream intersection, and the downstream intersection over a historical period;

obtain signals including a congestion period;

determine a discharge speed during the congestion period based on a portion of the historical track data, the portion of the historical track data being corresponding to the congestion period;

determine an offset value based on a length of the road, the discharge speed, a cycle length of a first traffic light, a cycle length of a second traffic light, and a time length of a green light of the second traffic light being lit, the first traffic light being at the downstream intersection, the second traffic light being at the upstream intersection, the cycle length of the first traffic light being equal to the cycle length of the second traffic light; and determine a signal timing of the second traffic light based on the offset value.

11. The system of claim 10, wherein the historical period includes a plurality of workdays.

12. The system of claim 10, wherein the historical track data of the plurality of vehicles includes data of positions of the plurality of vehicles on the road and corresponding time points at which the plurality of vehicles at the positions.

13. The system of claim 12, wherein to determine the discharge speed during the congestion period based on a portion of the historical track data corresponding to the congestion period, the processing circuits are further directed to:

determine, for each of a plurality of first vehicles that pass through a boundary between the road and the downstream intersection during the congestion period, a relative start time point based on historical track data corresponding to the each of the plurality of first vehicles; and determine the discharge speed based on the relative start time points of the plurality of first vehicles.

14. The system of claim 13, wherein to determine, for each of the plurality of first vehicles, the relative start timing based on the historical track data corresponding to the each of the plurality of first vehicles, the processing circuits are further directed to:

obtain signals including an actual start time point of the each of the plurality of first vehicles that the each of the plurality of first vehicles started to move from a stop condition and across the boundary between the road and the downstream intersection during a period of the green light of the first traffic light being lit;

obtain signals including a start time point of the period of the green light of the first traffic light being lit; and determine the relative start time point based on the actual start time point of the each of the plurality of first vehicles and the start time point of the period of the green light of the first traffic light being lit.

15. The system of claim 13, wherein to determine the discharge speed based on the relative start time points of the plurality of first vehicles, the processing circuits are further directed to:

determine the discharge speed based on the relative start time points of the plurality of first vehicles and corresponding positions of the plurality of first vehicles at the relative time points.

16. The system of claim 10, wherein to determine the offset value based on the length of the road, the discharge speed, the cycle length of the first traffic light, the cycle length of the second traffic light, and the time length of the green light of the second traffic light being lit, the processing circuits are further directed to:

determine an offset value range based on the length of the road, the discharge speed, the cycle length of the first traffic light, the cycle length of the second traffic light, and the time length of the green light of the second traffic light being lit; and determine the offset value based on the offset value range.

17. The system of claim 10, wherein the length of the road includes a length of the upstream intersection.

18. The system of claim 10, wherein to determine the signal timing of the second traffic light based on the offset value, the processing circuits are further directed to:

control the second traffic light to delay for the offset value relative to the first traffic light corresponding to the congestion period.

19. The system of claim 10, wherein to determine the signal timing of the second traffic light based on the offset value, the processing circuits are further directed to:

determine a first time point that the green light of the first traffic light starts to be on for a first time;

determine a second time point based on the first time point and the offset value;

extend a period of a red light of the second traffic light to the second time point; and light the green light of the second traffic light at the second time point.

20. A non-transitory computer readable medium, comprising at least one set of instructions for controlling traffic lights of an upstream intersection and a downstream intersection linked by a road, wherein when executed by processing circuits of a computing device, the at least one set of instructions causes the computing device to perform a method, the method comprising:

obtaining, from a server, signals including historical track data of a plurality of vehicles that passed the road, the upstream intersection, and the downstream intersection over a historical period;

obtaining signals including a congestion period;

determining a discharge speed during the congestion period based on a portion of the historical track data, the portion of the historical track data being corresponding to the congestion period;

determining an offset value based on a length of the road, the discharge speed, a cycle length of a first traffic light, a cycle length of a second traffic light, and a time length of a green light of the second traffic light being lit, the first traffic light being at the downstream intersection, the second traffic light being at the upstream intersection, the cycle length of the first traffic light being equal to the cycle length of the second traffic light; and determining a signal timing of the second traffic light based on the offset value.

* * * * *